US010352516B2

(12) United States Patent
Jach et al.

(10) Patent No.: US 10,352,516 B2
(45) Date of Patent: Jul. 16, 2019

(54) FLAME SIMULATING ASSEMBLY

(71) Applicant: Glen Dimplex Americas Limited, Cambridge (CA)

(72) Inventors: Michael Jach, Kitchener (CA); Kristoffer Hess, Cambridge (CA); Ignazio Gallo, Cambridge (CA)

(73) Assignee: Glen Dimplex Americas Limited, Cambridge, Ontario (CA)

( * ) Notice: Subject to any disclaimer, the term of this patent is extended or adjusted under 35 U.S.C. 154(b) by 157 days.

(21) Appl. No.: 15/458,086

(22) Filed: Mar. 14, 2017

(65) Prior Publication Data

US 2017/0268738 A1 Sep. 21, 2017

Related U.S. Application Data

(60) Provisional application No. 62/309,123, filed on Mar. 16, 2016.

(51) Int. Cl.

| | |
|---|---|
| ***F21S 10/04*** | (2006.01) |
| ***F21V 3/02*** | (2006.01) |
| ***F21V 11/00*** | (2015.01) |
| ***F21V 14/04*** | (2006.01) |
| ***G09F 19/12*** | (2006.01) |
| ***F24C 3/00*** | (2006.01) |
| ***F24C 7/00*** | (2006.01) |

(52) U.S. Cl.

CPC ..... *F21S 10/046* (2013.01); *F21V 3/02* (2013.01); *F21V 11/00* (2013.01); *F21V 14/04* (2013.01); *F24C 3/006* (2013.01); *F24C 7/004* (2013.01); *G09F 19/12* (2013.01)

(58) Field of Classification Search

CPC ..... F21S 10/046; F24C 3/006; F24C 7/004; A63J 5/023

USPC ..... 40/428

See application file for complete search history.

(56) References Cited

U.S. PATENT DOCUMENTS

| | | | |
|---|---|---|---|
| 2,684,244 | A | 7/1954 | Brooks |
| 2,984,032 | A | 5/1961 | Cornell |
| 3,499,239 | A | 3/1970 | Mungo |

(Continued)

FOREIGN PATENT DOCUMENTS

| | | | |
|---|---|---|---|
| CA | 2300710 | A1 | 9/2000 |
| EP | 1439351 | A2 | 7/2004 |

(Continued)

OTHER PUBLICATIONS

European Search Report dated Jul. 24, 2017, pertaining to European Patent Application No. EP 17160550.4.

*Primary Examiner* — Gary C Hoge

(57) ABSTRACT

A flame simulating assembly including a light source, a screen having a translucent region which subjects light from the light source transmitted therethrough to diffusion and a transparent region, and a flicker element for intermittently reflecting the light from the light source toward the screen, to provide images of flames in a predetermined portion thereof. The screen includes a fringe region positioned between the translucent region and the transparent region. The fringe region includes a number of diffusing areas for diffusing the light from the light source and a number of transparent areas positioned between the diffusing areas, to at least partially provide images of flames in the diffusing areas.

24 Claims, 28 Drawing Sheets

(56) References Cited

U.S. PATENT DOCUMENTS

| | | | | |
|---|---|---|---|---|
| 3,526,984 | A | 9/1970 | Nielsen et al. | |
| 4,026,544 | A | 5/1977 | Plambeck et al. | |
| 4,890,600 | A | 1/1990 | Meyers | |
| 4,965,707 | A | 10/1990 | Butterfield | |
| 5,162,145 | A * | 11/1992 | Schaefer | B32B 17/10036 428/209 |
| 5,390,595 | A * | 2/1995 | Cutcher | G03F 7/12 101/128.21 |
| 5,642,580 | A | 7/1997 | Hess et al. | |
| 6,047,489 | A | 4/2000 | Hess et al. | |
| 6,050,011 | A * | 4/2000 | Hess | F21S 10/04 40/427 |
| 6,162,047 | A | 12/2000 | Hess | |
| 6,363,636 | B1 | 4/2002 | Hess et al. | |
| 6,385,881 | B1 | 5/2002 | Hess | |
| 6,393,207 | B1 | 5/2002 | Martin et al. | |
| 6,564,485 | B1 | 5/2003 | Hess | |
| 6,691,440 | B1 | 2/2004 | Petz et al. | |
| 6,757,487 | B2 | 6/2004 | Martin et al. | |
| 6,880,275 | B2 | 4/2005 | Mix et al. | |
| 7,080,472 | B2 | 7/2006 | Schroeter et al. | |
| 7,111,421 | B2 | 9/2006 | Corry et al. | |
| 7,134,229 | B2 | 11/2006 | Hess et al. | |
| 7,162,820 | B2 | 1/2007 | Hess et al. | |
| 7,210,256 | B2 | 5/2007 | Rosserot | |
| 7,373,743 | B1 | 5/2008 | Hess | |
| 7,668,442 | B2 | 2/2010 | O'Neill | |
| 7,673,408 | B2 | 3/2010 | Hess et al. | |
| 7,770,312 | B2 | 8/2010 | Stinson et al. | |
| 8,661,721 | B2 | 3/2014 | Hess et al. | |
| 8,739,439 | B2 | 6/2014 | Asofsky et al. | |
| 9,453,627 | B1 | 9/2016 | Chen | |
| 2002/0139021 | A1 | 10/2002 | Hess et al. | |
| 2003/0041491 | A1 | 3/2003 | Mix | |
| 2003/0046837 | A1 * | 3/2003 | Hess | F24C 7/004 40/428 |
| 2003/0049024 | A1 | 3/2003 | Chen | |
| 2003/0110671 | A1 | 6/2003 | Hess | |
| 2003/0156828 | A1 | 8/2003 | Jamieson et al. | |
| 2004/0060213 | A1 | 4/2004 | Schroeter et al. | |
| 2004/0181983 | A1 | 9/2004 | Hess et al. | |
| 2004/0264949 | A1 | 12/2004 | Deng | |
| 2005/0097792 | A1 | 5/2005 | Naden | |
| 2006/0101681 | A1 | 5/2006 | Hess et al. | |
| 2006/0188831 | A1 | 8/2006 | Hess et al. | |
| 2006/0242870 | A1 | 11/2006 | Atemboski et al. | |
| 2007/0094903 | A1 * | 5/2007 | Hess | F24C 7/004 40/428 |
| 2007/0107280 | A1 * | 5/2007 | Stinson | F24C 7/004 40/428 |
| 2007/0175074 | A1 | 8/2007 | O'Neill | |
| 2008/0227041 | A1 * | 9/2008 | Kirchner | F24C 3/006 431/125 |
| 2009/0126241 | A1 | 5/2009 | Asofsky | |
| 2011/0127914 | A1 | 6/2011 | Patton et al. | |
| 2016/0258585 | A1 | 9/2016 | Gallo et al. | |

FOREIGN PATENT DOCUMENTS

| | | | |
|---|---|---|---|
| GB | 414280 | | 8/1934 |
| GB | 1113209 | | 5/1968 |
| GB | 1164143 | | 9/1969 |
| GB | 1298455 | | 12/1972 |
| GB | 2180927 | A | 4/1987 |
| GB | 2230335 | A | 10/1990 |
| GB | 2288052 | A | 10/1995 |
| GB | 2298073 | A | 8/1996 |
| GB | 2315543 | A | 2/1998 |
| GB | 2372807 | A | 9/2002 |
| GB | 2402469 | A | 12/2004 |
| WO | WO2004027321 | A1 | 4/2004 |
| WO | WO2005078350 | A1 | 8/2005 |
| WO | WO2006040167 | A2 | 4/2006 |
| WO | 2007021186 | A2 | 2/2007 |
| WO | WO2008149117 | A2 | 12/2008 |

* cited by examiner

158

FLAME SIMULATING ASSEMBLY

CROSS-REFERENCE TO RELATED APPLICATIONS

This application claims the benefit of U.S. Provisional Patent Application No. 62/309,123, filed on Mar. 16, 2016, the entirety of which is hereby incorporated by reference.

FIELD OF THE INVENTION

The present invention is a flame simulating assembly including a screen with translucent and transparent regions thereof and a fringe region therebetween.

BACKGROUND OF THE INVENTION

Various electric fireplaces are known, providing flame simulation effects with varying degrees of success. In many, the electric fireplace includes a screen with front or rear surfaces that are formed or treated so that, across their entire areas, light that is directed therethrough is diffused. However, this type of screen has some disadvantages. For instance, the known screen (e.g., with its entire rear surface treated to diffuse light transmitted therethrough) imposes certain limits on the possible arrangements of elements in an electric fireplace. Also, the flame simulation effects provided by such a screen may tend to be somewhat unconvincing, depending on the observer's perspective.

SUMMARY OF THE INVENTION

There is a need for a flame simulating assembly that overcomes or mitigates one or more of the disadvantages or defects of the prior art. Such disadvantages or defects are not necessarily included in those described above.

In its broad aspect, the invention provides a flame simulating assembly including one or more light sources for providing light, a screen including a translucent region which subjects the light from the light source transmitted therethrough to diffusion and a transparent region, and a flicker element for intermittently reflecting the light from the light source toward the back surface of the screen, to provide images of flames in a predetermined portion thereof. The screen also includes a fringe region at least partially positioned between the translucent region and the transparent region. The fringe region includes a number of diffusing areas for diffusing the light from the light source and a number of transparent areas positioned between the diffusing areas, to at least partially provide images of flames in the diffusing areas.

BRIEF DESCRIPTION OF THE DRAWINGS

The invention will be better understood with reference to the attached drawings, in which.

DETAILED DESCRIPTION

Figure 1:
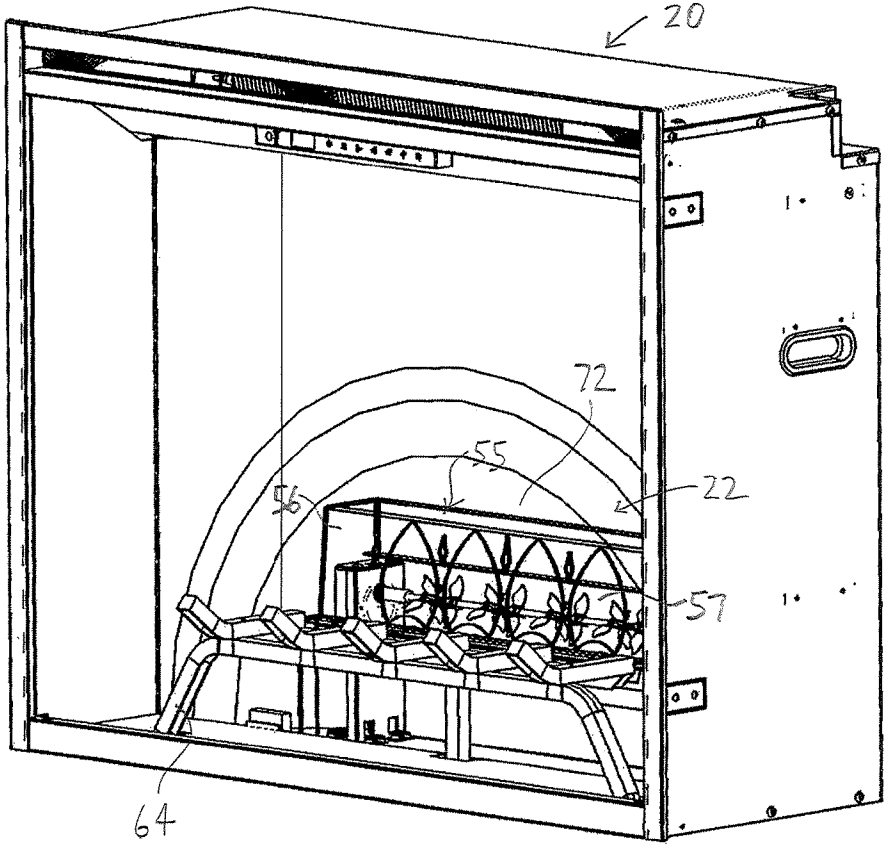
FIG. 1 is an isometric view of an embodiment of the flame simulating assembly of the invention.

In the attached drawings, like reference numerals designate corresponding elements throughout. Reference is first made to FIGS. 1-8 to describe an embodiment of a flame simulating assembly in accordance with the invention indicated generally by the numeral 20. In one embodiment, the flame simulating assembly 20 preferably includes one or more light sources 21 for producing light and a screen 22 having a front surface 24 facing toward a front side 26 of the flame simulating assembly 20 and a back surface 28 opposed to the front surface 24 (FIG. 2E). As can be seen in FIG. 2B, it is preferred that the screen 22 includes one or more translucent regions 30 which subjects the light from the light source 21 transmitted therethrough to diffusion, and a transparent region 32, as will be described. Preferably, the flame simulating assembly 20 also includes a flicker element 34

Figure 4A:
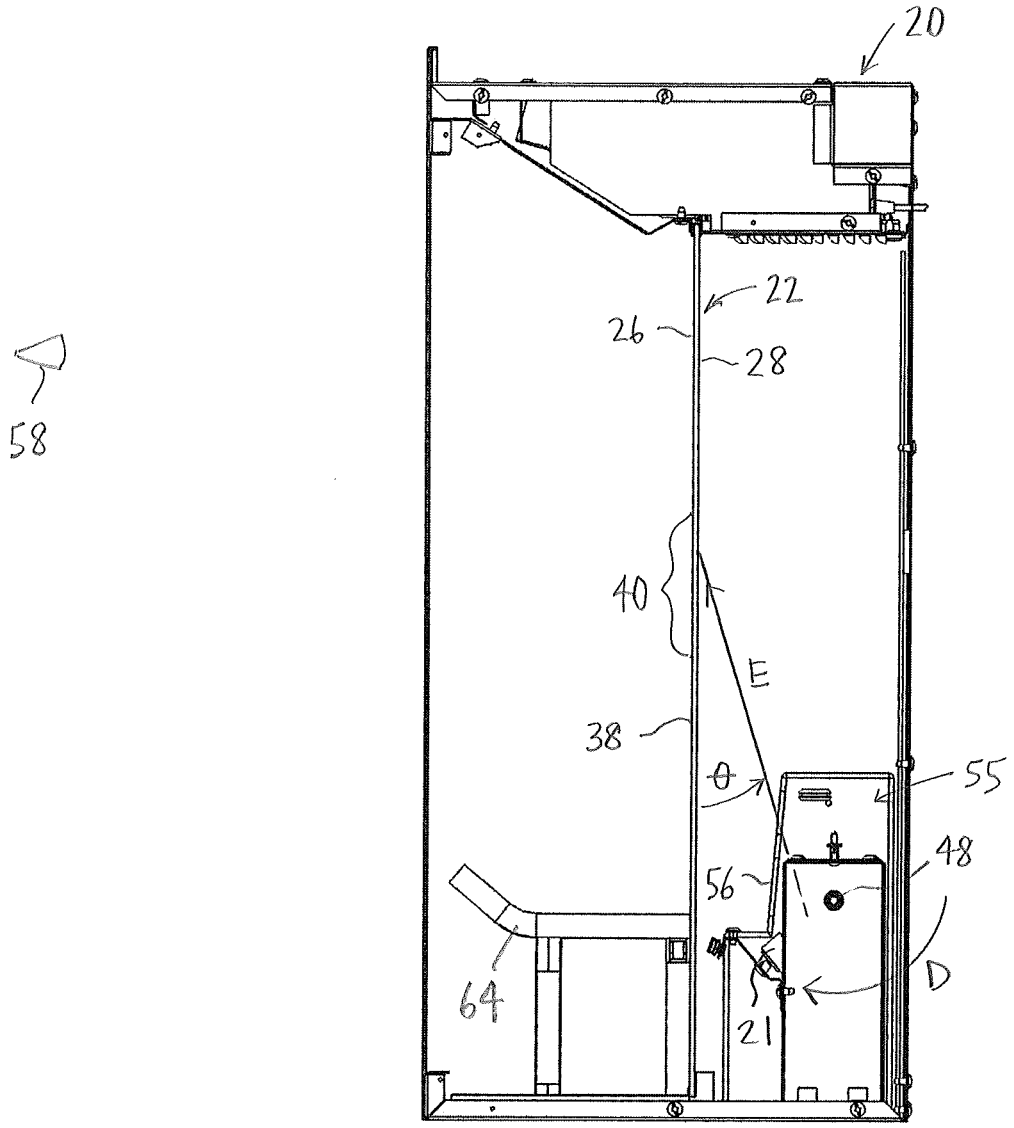
FIG. 4A is a side view of the flame simulating assembly of FIG. 1 with certain elements removed, drawn at a smaller scale.
Figure 4B:
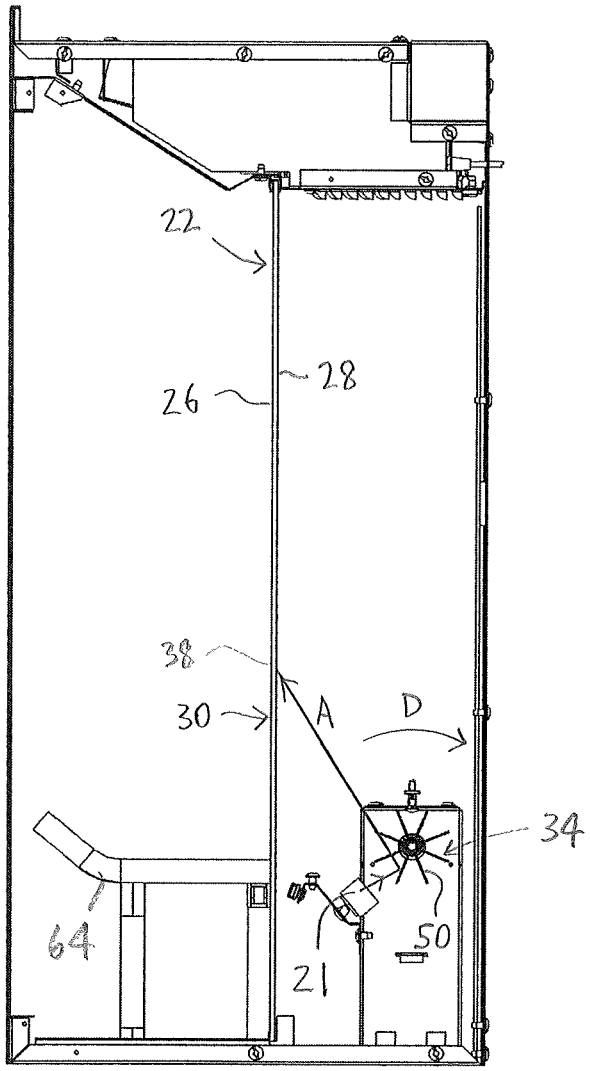
FIG. 4B is another side view of the flame simulating assembly of FIG. 1.

(FIGS. 2E, 3B, 4B) for intermittently reflecting the light from the light source 21 toward the back surface 28 of the screen 22, to provide images 36 of flames in a predetermined portion 38 of the screen 22 (FIGS. 2B, 4A, 4B). It is also preferred that the screen 22 includes one or more fringe regions 40 positioned at least partially between the translucent and transparent regions 30, 32 (FIG. 2B). Preferably, and as illustrated in FIG. 2C, the fringe region 40 includes a number of diffusing areas 44 for diffusing the light from the light source(s) 21 and a number of transparent areas 46 positioned between the diffusing areas 44, to provide the images of flames 36 in the diffusing areas 44, as will also be described.

It will be understood that, although the translucent region 30, the transparent region 32, and the fringe region 40 are schematically illustrated in FIGS. 1, 2A, 2B, 3A, 5, 6A, and 8 as being distinct from each other along clearly defined lines, in fact, the boundaries between these regions on the screen 22 preferably are not distinct. The translucent region 30, the transparent region 32, and the fringe region 40 are schematically illustrated in certain drawings as having clearly defined boundaries between them respectively solely to simplify the drawings. The fringe region 40 provides a gradual transition between the translucent region 30, in which the light from the light source 21 that is transmitted therethrough is subjected to diffusion, and the transparent region 32, in which the light transmitted therethrough is subjected to virtually no diffusion, because the region 32 is transparent. Preferably, the transition is uniform as well as gradual. As will be described, the fringe region 40 contributes to the overall realistic simulation of a fire because it is formed to provide images of flames only in certain locations across the screen 22, to simulate the separation of tips or upper ends of flames in a fire.

Figure 2A:
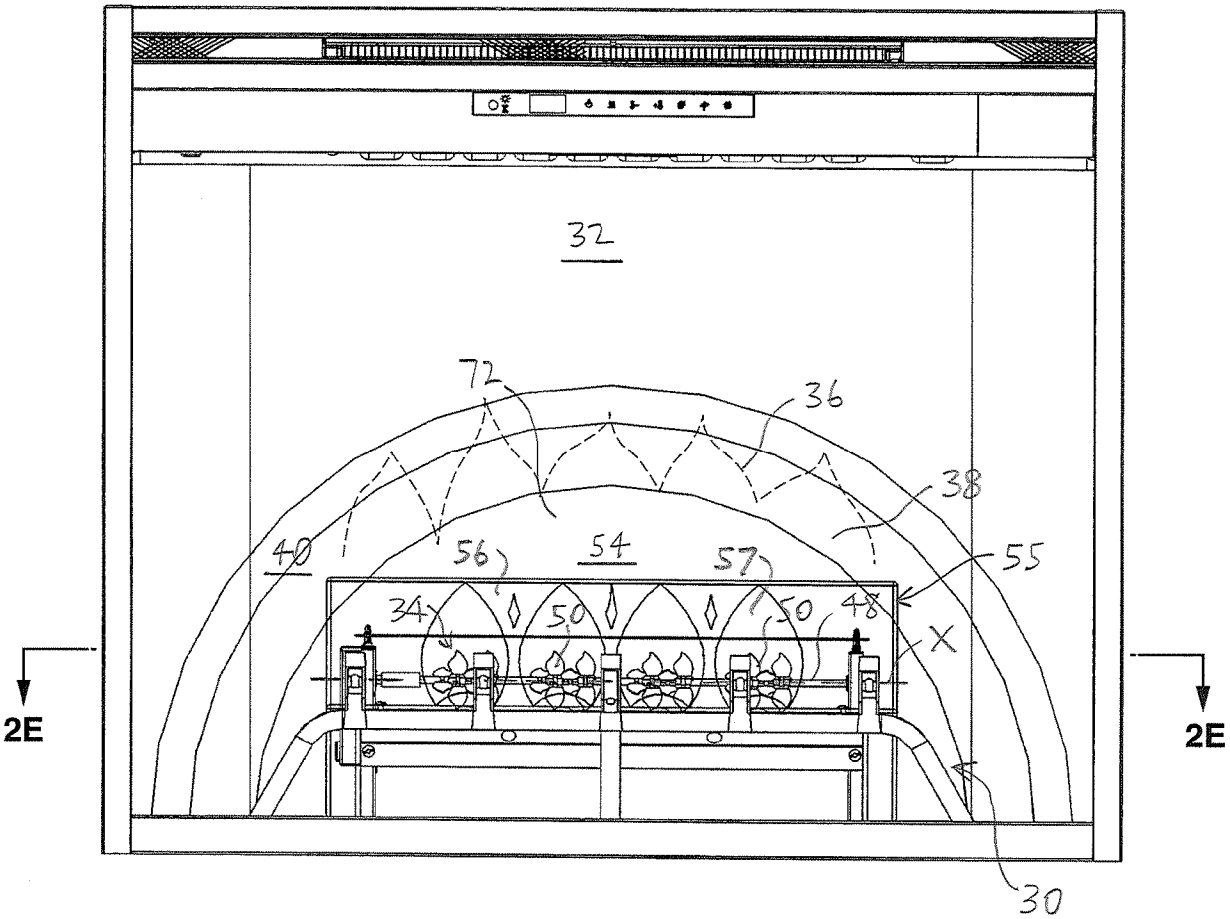
FIG. 2A is a front view of the flame simulating assembly of FIG. 1.
Figure 2B:
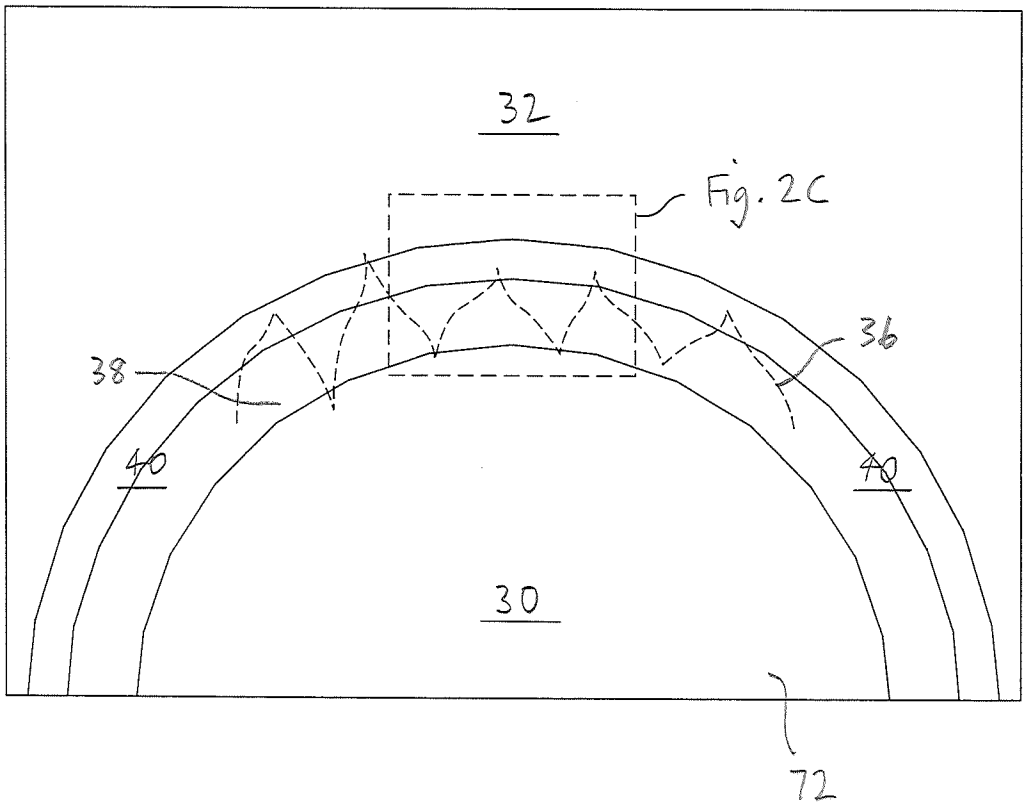
FIG. 2B is a front view of an embodiment of a screen of the invention in the flame simulating assembly of FIG. 1.
Figure 2C:
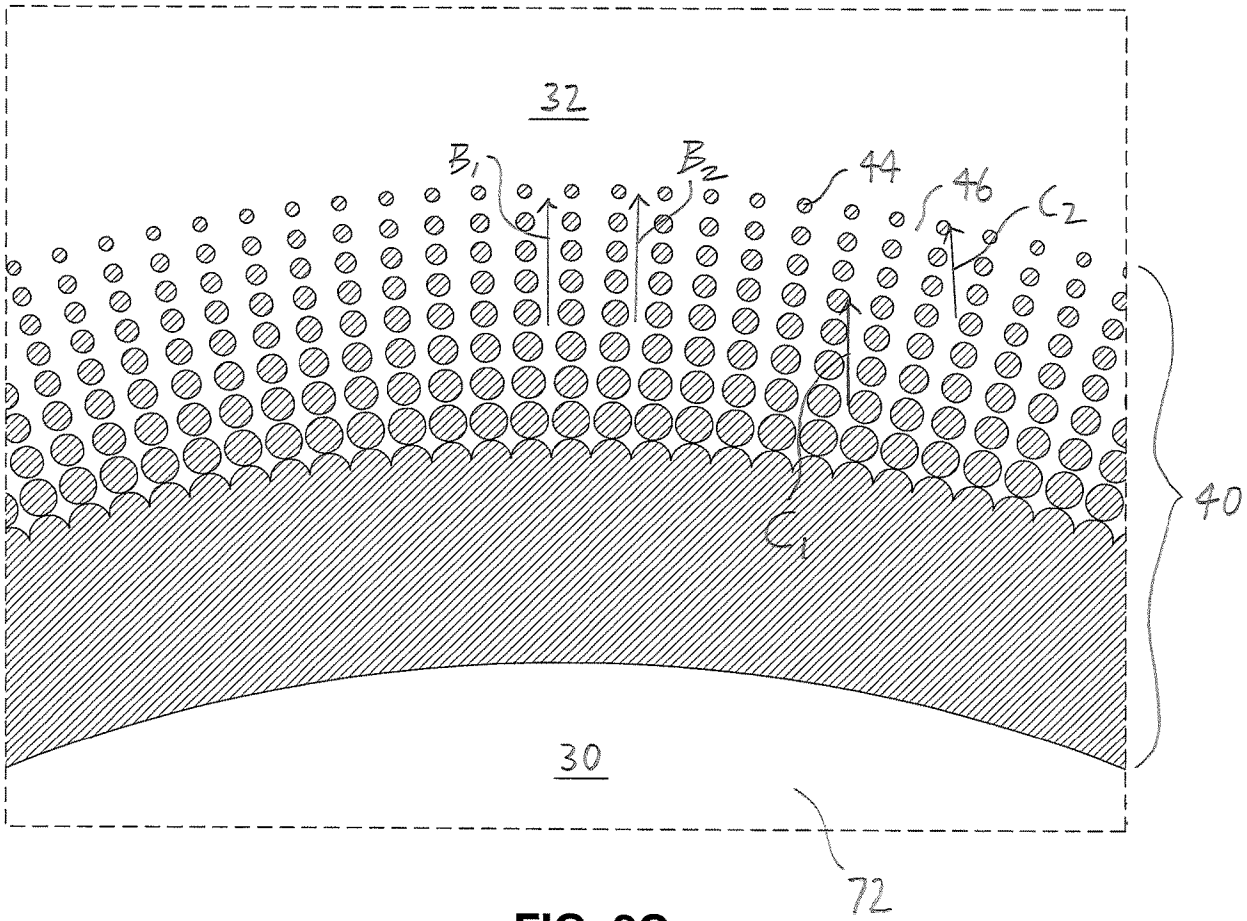
FIG. 2C is a portion of an embodiment of a fringe region of the invention, on the screen of FIG. 2B, drawn at a larger scale.

A portion of the fringe region 40 is illustrated in FIG. 2C. It will be understood that the illustration of the diffusing areas 44 and the transparent areas 46 in FIG. 2C is idealized. In FIG. 2C, the diffusing areas 44 and the transparent areas 46 are shown as having generally regular shapes. Also, the diffusing areas 44 are shown as gradually decreasing in size, from the translucent region 30 toward the transparent region 32. Correspondingly, the transparent areas 46 are shown in FIG. 2C as gradually increasing in size, moving from the translucent region 30 toward the transparent region 32. However, it will be understood that, in one embodiment, the shapes and sizes of the diffusing areas 44 and the transparent areas 46 may be irregular, i.e., the shapes and sizes of the areas 44, 46 may vary widely, and the diffusing areas 44 may not necessarily decrease gradually in size, when considered from the translucent region 30 to the transparent region 32. Also, the transparent areas 46 that are located proximal to the translucent region 30 may not necessarily be smaller than those located proximal to the transparent region 32. Also, the shapes of the diffusing areas 44 and the transparent areas 46 may vary widely in the same fringe region 40.

Those skilled in the art would appreciate that the flicker element 34 may have various configurations. In one embodiment, the flicker element 34 preferably includes a rod 48 defining an axis "X", and a number of paddle elements 50 mounted on the rod 48 (FIGS. 2A, 2E). It is also preferred that the paddle elements 50 are reflective. The flicker element 34 is rotatable about the axis "X", as is known in the art. The direction of rotation of the flicker element 34 about the axis "X" is indicated by arrow "D" in FIGS. 4A and 4B. Preferably, when the light source is energized, the light from the light source 21 is directed onto the flicker element 34 (i.e., onto the paddle elements 50) when the flicker element 34 is rotating, so that the light that is reflected from the paddle elements 50 toward the screen 22 is intermittent, i.e., flickering or varying in intensity, similar to the flickering or fluctuating flames of a fire.

Those skilled in the art would also appreciate that the translucent region 30 preferably subjects the light from the light source that is transmitted therethrough to diffusion, to the extent necessary to provide a realistic flame simulation effect. Because of the light-diffusing nature of the translucent region 30, the region also serves to at least partially conceal the elements of the flame simulating assembly 20 that are located behind the screen 22. Those skilled in the art would also appreciate that the translucent region 30 may be created using any suitable method, e.g., by spraying a suitable finish on the front or back surfaces 26, 28, or by a silk screening technique. In one embodiment, the translucent region 30 preferably includes a central sub-region 54 that is located in a predetermined location on the predetermined portion 38 of the screen 22, as can be seen in FIG. 2A. Preferably, the predetermined location of the central sub-region 54 is selected such that the images of flames 36 appear to originate from the central sub-region 54 (FIG. 2A).

Those skilled in the art would appreciate that the light source(s) 21 and the flicker element 34 may be positioned in any locations relative to each other, and relative to the screen 22, that will provide suitable images of flames 36. In FIG. 4B, for example, part of the light from the light source 21 that is reflected from the flicker element 34 toward the back surface 28 opposite the predetermined portion 38 is schematically represented by arrow "A".

It will be understood that the light from the light source 21 preferably is directed toward the back surface 28 so that the light is transmitted through all of the regions 30, 40, and 32. As illustrated in FIG. 4A, the light that is reflected from the flicker element 34 toward the screen 22 is directed at the screen's back surface 28 in the fringe region 40 at a relatively sharp angle. The light from the light source 21 that is reflected toward the back surface 28 of the screen 22 at the fringe region 40 is schematically represented by arrow "E" in FIG. 4A. It will be understood that FIGS. 4A and 4B are exemplary only.

It will also be understood that a number of elements are omitted from the drawings for clarity of illustration. For example, certain elements are omitted from FIGS. 4A and 4B for clarity of illustration.

As illustrated in FIG. 2C, part of the light from the light source 21 that is reflected from the flicker element 34 toward the back surface 28 is transmitted through the transparent areas 46. This portion of the light is schematically represented by arrows "$B_1$" and "$B_2$" in FIG. 2C.

Also, another part of the light that is reflected from the flicker element 34 toward the back surface 28 is transmitted through the diffusing areas 44. This portion of the light is schematically represented by arrows "$C_1$" and "$C_2$" in FIG. 2C.

The light that is transmitted through the diffusing areas 44 is diffused, and thus provides upper parts of the images of flames 36, in the diffusing areas 44 only. Because of this, the fringe region 40 provides a realistic transition between the translucent region 30 and the transparent region 32.

From the foregoing, it can be seen that the fringe region 40 provides realistic images of the upper parts of flames, between the translucent region 30, and the transparent region 32. As can be seen in FIG. 2A, the translucent region 30 preferably is positioned in or on the screen generally lower than the transparent region 32. It will be understood that a larger part of the images of flames are provided in the translucent region 30, i.e., due to light from the light source 21 that is reflected by the flicker element 34 toward the back surface of the screen in the translucent region 30.

From the foregoing, it can also be seen that the parts of the images of flames that are provided in the fringe region 40 are provided only in the diffusing areas 44. The light from the light source 21 that is reflected to the transparent areas 46 is transmitted through the transparent areas 46, with substantially no diffusion thereof. Accordingly, the parts of the images of flames provided in the fringe region 40 are separated laterally from each other by the transparent areas 46. As can be seen, e.g., in FIG. 2A, the parts of the images of flames that are viewable in the fringe region 40 tend to be generally smaller in area toward the upper side of the fringe region 40 as a result. In addition, the relatively acute angle at which the light is directed toward the fringe region 40 tends to cause a "feathering" effect, in which the light that is directed to the screen at the acute angle is transmitted through the screen to provide upper parts of the images of flames that are gradually decreasing in intensity (and fading) toward the upper side of the fringe region 40.

Figure 2D:
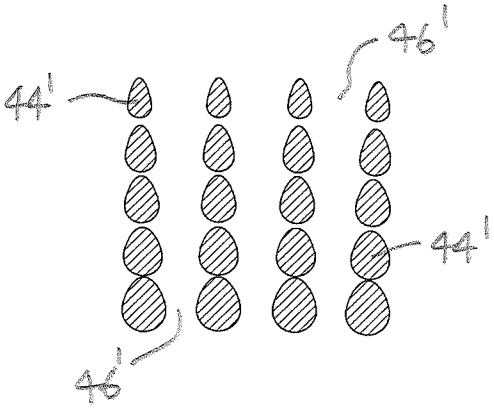
FIG. 2D is a portion of an alternative embodiment of the fringe region of the invention.

Those skilled in the art would appreciate that the diffusing areas 44 in the fringe region 40 may be created using any suitable method. For instance, in one embodiment, the diffusing areas 44 may be created by spraying a suitable finish onto the back surface 28 (or the front surface 26, as the case may be) of the screen 22. Alternatively, the diffusing areas 44 may be created using a silk screening technique. In one embodiment, the diffusing areas 44 are substantially round (FIG. 2C). In an alternative embodiment, diffusing areas 44' are at least partially oblong, and separated by transparent areas 46' (FIG. 2D). Preferably, although not necessarily, the diffusing areas 44 are provided using generally the same method as that used to provide the translucent region 30.

In one embodiment, the flame simulating assembly 20 preferably also includes a flicker element housing 55 for at least partially concealing the flicker element 34. As can be seen, for example, in FIGS. 2A and 3A, the flicker element housing 55 preferably includes a flicker element housing body 56 with openings 57 (FIGS. 2A, 6A) therein through which the light from the light source 21 is directed to the flicker element 34, and also through which the light reflected from the flicker element 34 passes outwardly. Otherwise, however, the flicker element 34 is generally covered by the flicker element housing 55.

The flicker element housing 55 is formed to generally cover the flicker element 34 (i.e., except for the openings 57) and has two purposes. First, because a substantial portion of the screen 22 is transparent, an observer 58 (FIG. 4A) is generally able to observe a substantial portion of the flame simulating assembly's elements that are positioned behind the screen 22. In particular, the observer 58 who is positioned a relatively short distance away from the flame simulating assembly 20 is able to observe many of the elements that are located behind the screen 22, via the transparent region 32. The flicker element 34 therefore is at least partially covered by the flicker element housing 55, in order that the flame effect provided may seem more realistic to the observer. Accordingly, and as will be described further below, it is desirable to cover or obscure the mechanical and electrical elements that generate the flame effect, to enhance the realism of the flame effect as presented to the observer.

Second, the flicker element housing 55 guides the light reflected from the flicker element 34 as desired toward a selected part of the screen 22. That is, the light reflected from the flicker element 34 is not directed indiscriminately therefrom, because the light reflected from the flicker element 34 may only be transmitted through the openings 57. The reflected light is controlled or shielded by the flicker element housing body 56 so as to provide a more realistic flame simulation to the observer. In particular, the light reflected from the flicker element 34 is configured or guided by the openings 57 to form the images of flames on the screen 22. Those skilled in the art would appreciate that it is necessary to conceal the flicker element 34 and to shield or cover the light from the light source 21 that is directed to the flicker element 34 and reflected therefrom because the observer 58 may be able to view the portion of the flame simulating assembly 20 that is behind the screen 22, at least via the transparent region 32.

Preferably, trim elements are formed, and positioned in front of the central sub-region 54, to enhance the simulation of a fire provided by the flame simulating assembly 20. For example, in one embodiment, the flame simulating assembly 20 preferably includes a front trim subassembly 60 positioned proximal to the central sub-region 54 (FIGS. 6A-6C). The trim subassembly 60 preferably is located in front of the central sub-region 54 in order to suggest that the images of flames 36 are rising from the trim subassembly 60, to enhance the overall simulation effect provided by the flame simulating assembly 20. (It will be understood that the trim subassembly 60 is partially omitted from FIGS. 1, 2A, 2E, 3A-5, 8, and 9 to simplify the illustrations.)

It will also be understood that the trim subassembly 60 may have any suitable configuration. For instance, in one embodiment, the trim subassembly 60 preferably includes one or more simulated fuel elements 62 (FIGS. 6A-7B). Those skilled in the art would appreciate that the simulated fuel elements 62 may be provided in any suitable form. For example, as illustrated in FIGS. 6A-7B, the simulated fuel elements 62 are simulations of wooden logs. However, those skilled in the art would appreciate that the simulated fuel elements 62 may be any suitable objects, or formed to resemble any suitable objects, e.g., pieces of coal. Alternatively, for example, the simulated fuel elements 62 may be actual wooden logs.

In one embodiment, the trim subassembly 60 preferably includes a grate element 64, for supporting the simulated fuel elements 62. Also, the trim subassembly 60 preferably includes a simulated ember bed 66 positioned at least partially below the simulated fuel element(s) (FIGS. 6A-7B). In one embodiment, the simulated ember bed 66 preferably is formed to resemble a bed of embers, e.g., such as would result from burning wooden logs for a period of time. Alternatively, the simulated ember bed 66 may be provided in any other suitable form.

Those skilled in the art would be aware of suitable materials and methods of forming the simulated fuel elements 62, the grate element 64, and the simulated ember bed 66.

As noted above, the trim subassembly 60 may, alternatively, have other configurations, which may or may not include simulations of combustible fuel. For instance, the trim subassembly 60 may be a media bed arrangement (not shown) that is formed and positioned to appear to be a source of the images of flames. Those skilled in the art would appreciate that the media bed arrangement may include any suitable materials, in any suitable arrangement. As an example, the media bed arrangement of the trim subassembly 60 may include appropriately sized and colored pieces of crushed glass, or acrylic. For the purposes of description herein, however, the trim subassembly 60 is an exemplary simulated fuel bed.

In one embodiment, and in particular, where the trim subassembly 60 is a first simulated fuel bed that is located in front of the screen 22, it is preferred that the flicker element housing 55 additionally includes a second simulated fuel bed 68 (FIGS. 6A-7B). The second simulated fuel bed 68 is provided because the observer 58 may otherwise be able to observe the flicker element housing body 56, via the transparent region 32. Accordingly, the second simulated fuel bed 68 preferably is formed to conceal the flicker element housing body 56. As can be seen in FIGS. 6A-7B, the second simulated fuel bed 68 preferably includes second simulated fuel elements 70. It is also preferred that the second simulated fuel elements 70 are formed and positioned so that, with the simulated fuel elements 62, a realistic simulation is provided of a fire in which wooden logs are the combustible fuel. It will be understood that the second simulated fuel bed 68 may include additional elements other than the second simulated fuel elements 70, e.g., a second simulated ember bed (not shown) may also be included, to better conceal the flicker element housing body 56.

Those skilled in the art would appreciate that, where the trim subassembly 60 is an arrangement of elements other than the simulated fuel elements and related elements, the flicker element housing 55 may include one or more elements configured consistently with the trim subassembly 60, to conceal the flicker element housing body 56.

Figure 2E:
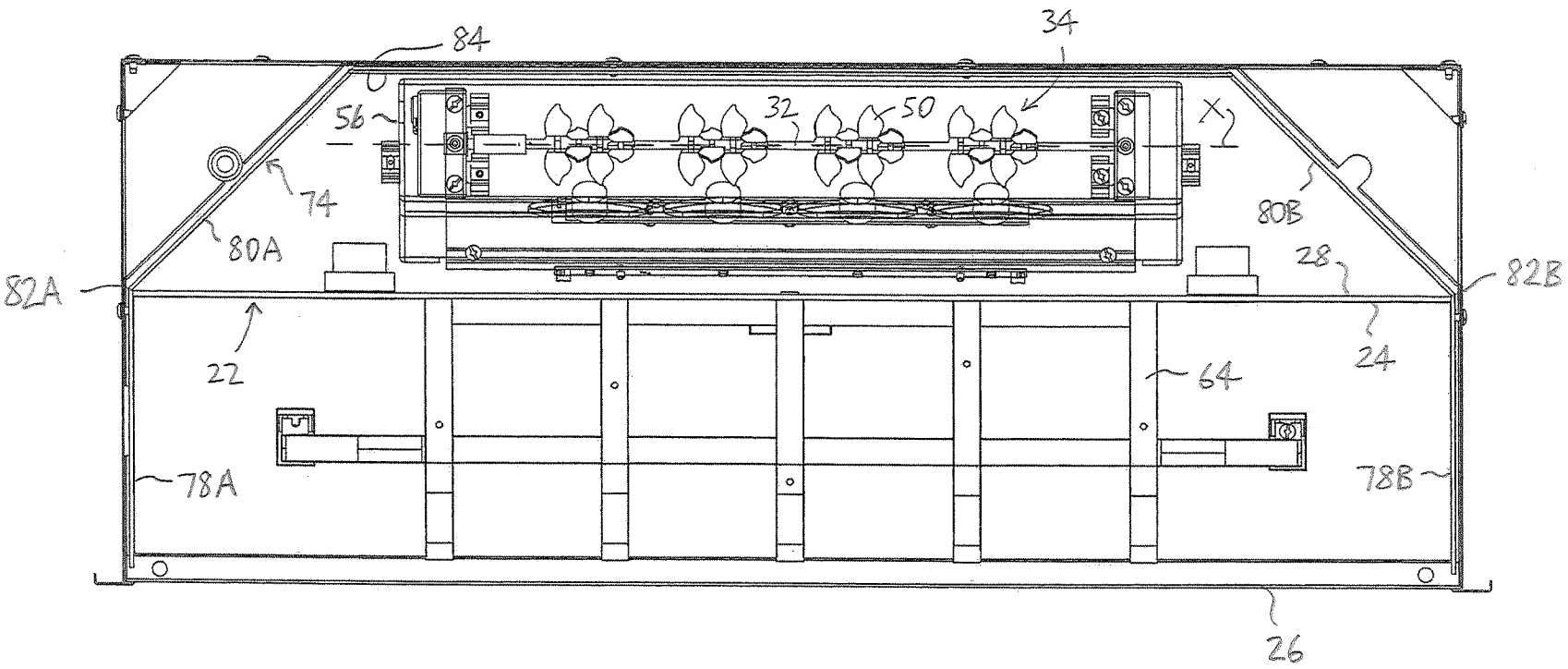
FIG. 2E is a horizontal cross-section of the flame simulating assembly of FIGS. 1 and 2A, drawn at a smaller scale.
Figure 3A:
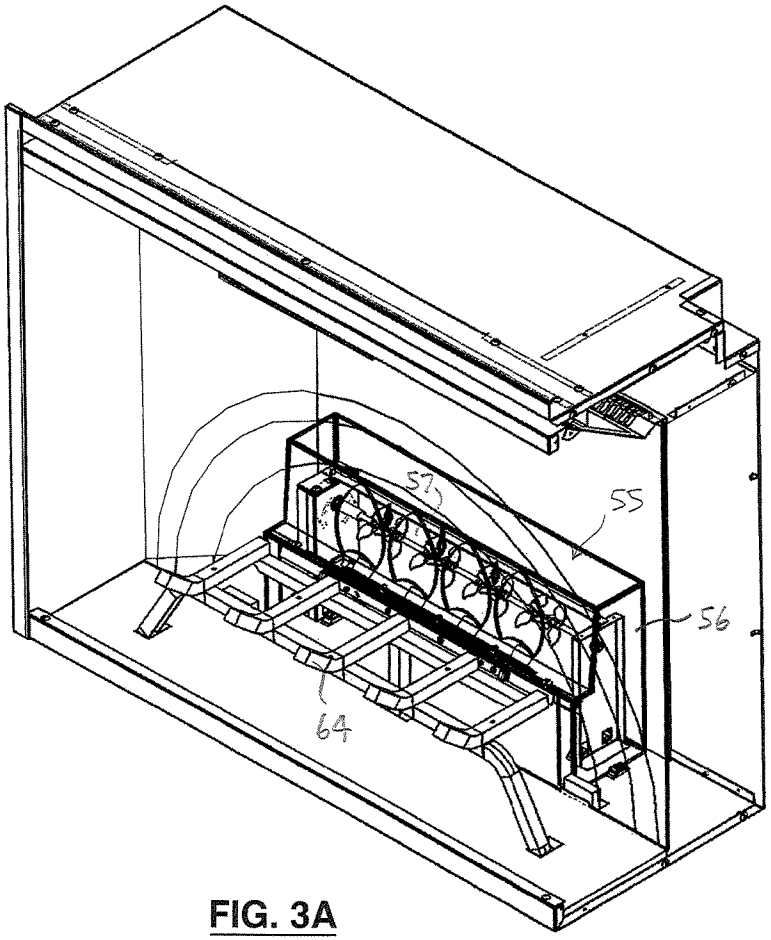
FIG. 3A is an isometric view of the flame simulating assembly of FIG. 1 with certain elements removed, drawn at a smaller scale.
Figure 3B:
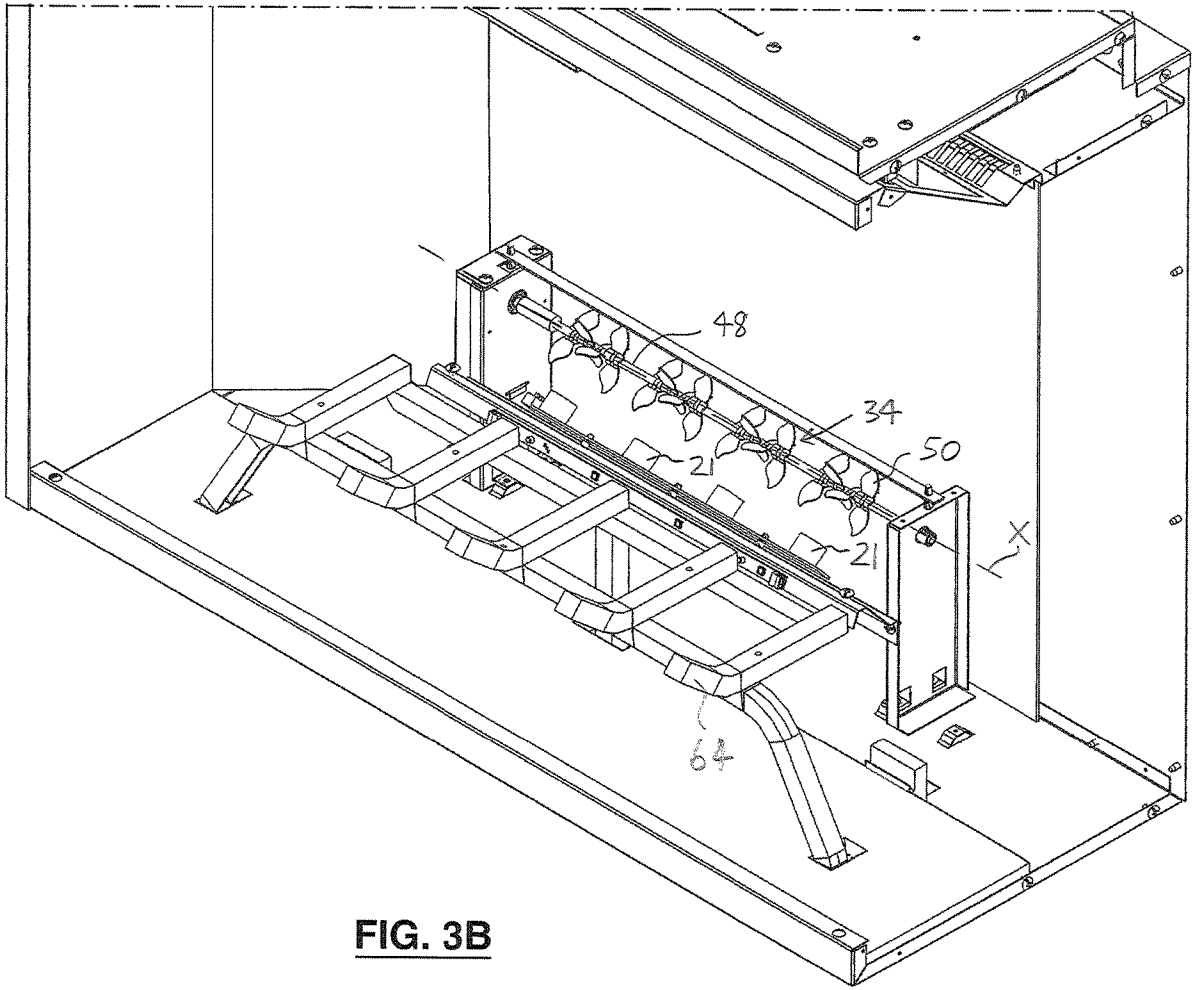
FIG. 3B is another isometric view of the flame simulating assembly, drawn at a larger scale.

In one embodiment, the flame simulating assembly 20 preferably also includes one or more partially reflective regions 72 that at least partially overlap with the translucent region 30 (FIGS. 1, 2A, 2B). It will be understood that the partially reflective region 72 may enhance the simulation of a real fire, by reflecting at least part of the trim subassembly 60. For example, where the trim subassembly 60 is a simulated fuel bed, part of the simulated fuel bed (e.g., parts of the simulated fuel elements 62) preferably is at least partially reflected in the reflective region 72, thereby providing an illusion that the trim subassembly or front simulated fuel bed 60 appears to have more depth than it does. Due to the partial reflection of parts of the front simulated fuel bed 60 in the partially reflective region 72, the images 36 of flames also appear to be rising out of the reflected images of such parts of the front simulated fuel bed 60, thereby enhancing the simulation effect provided by the flame simulating assembly 20.

Figure 5:
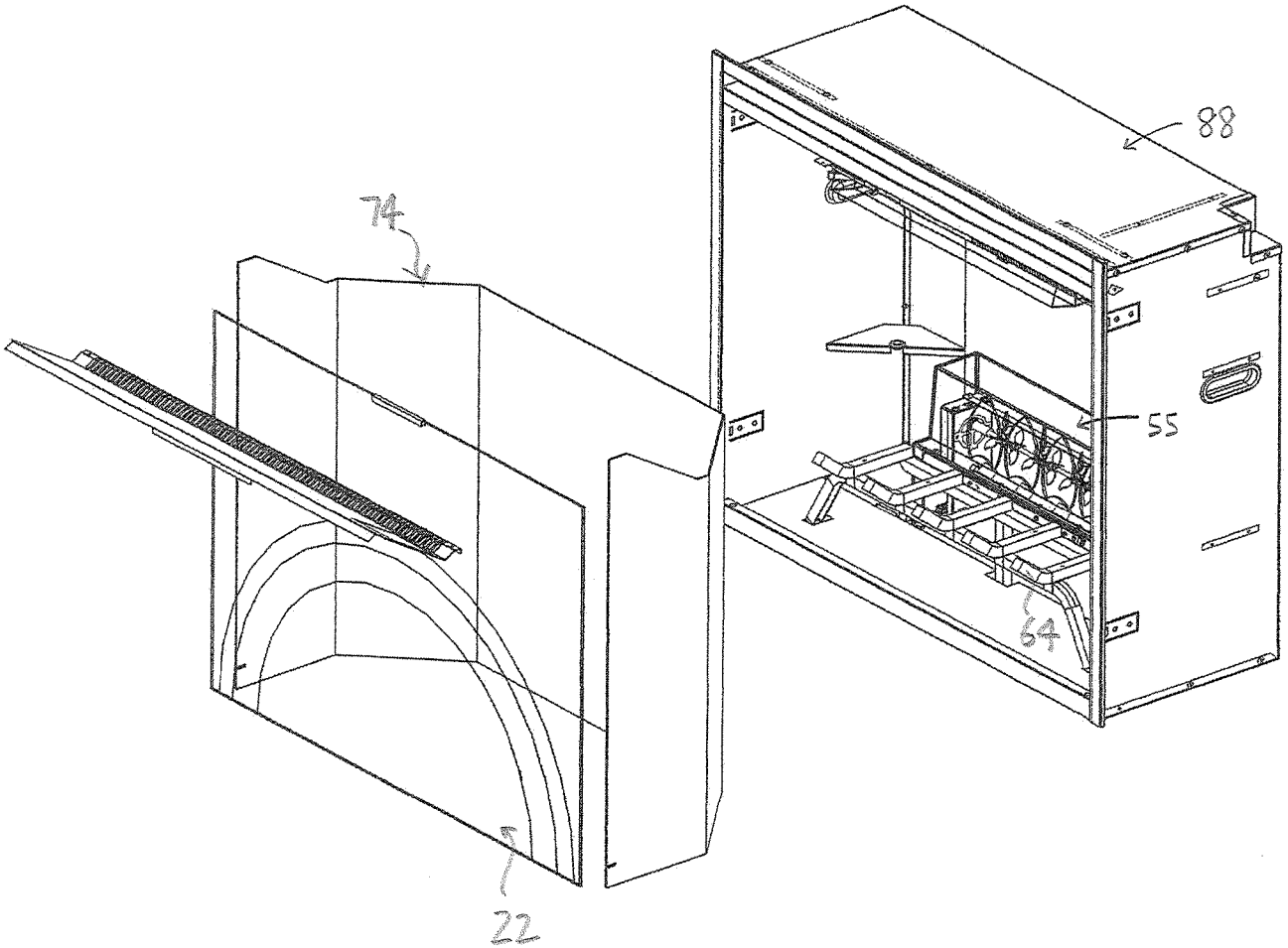
FIG. 5 is an exploded isometric view of the flame simulating assembly of FIG. 1.
Figure 6A:
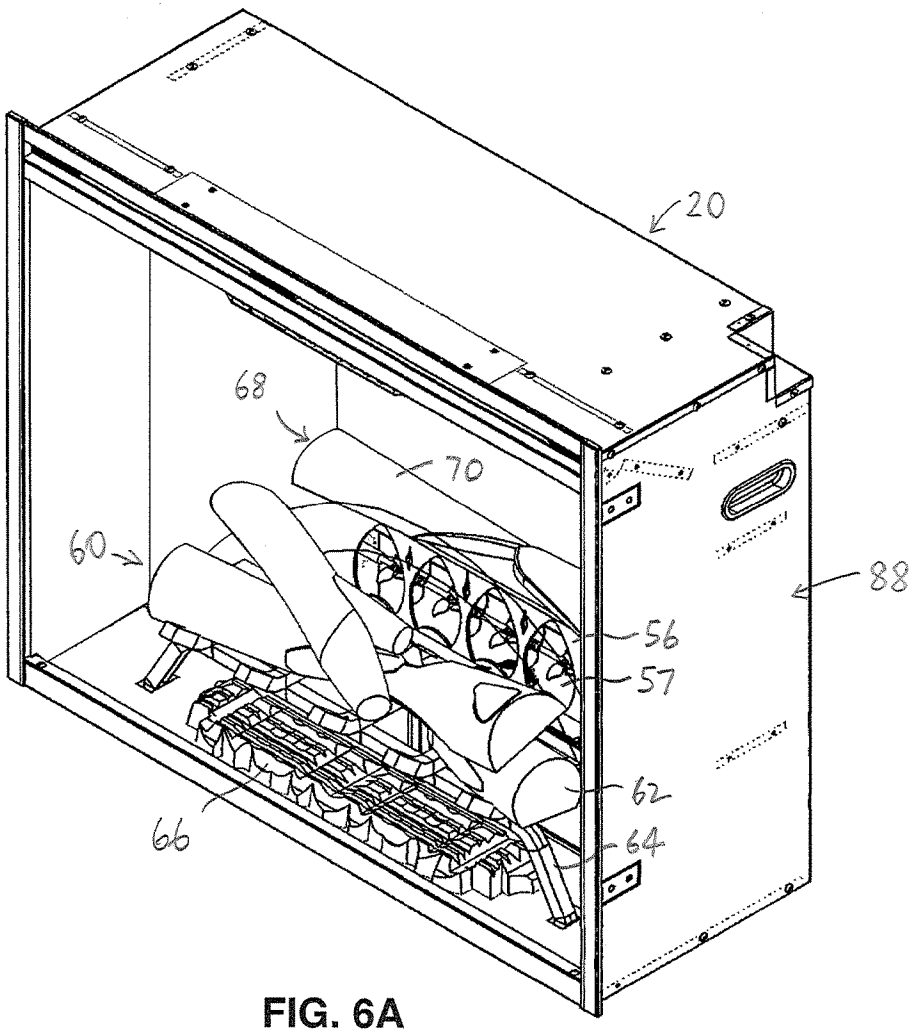
FIG. 6A is an isometric view of an alternative embodiment of the flame simulating assembly of the invention.
Figure 6B:
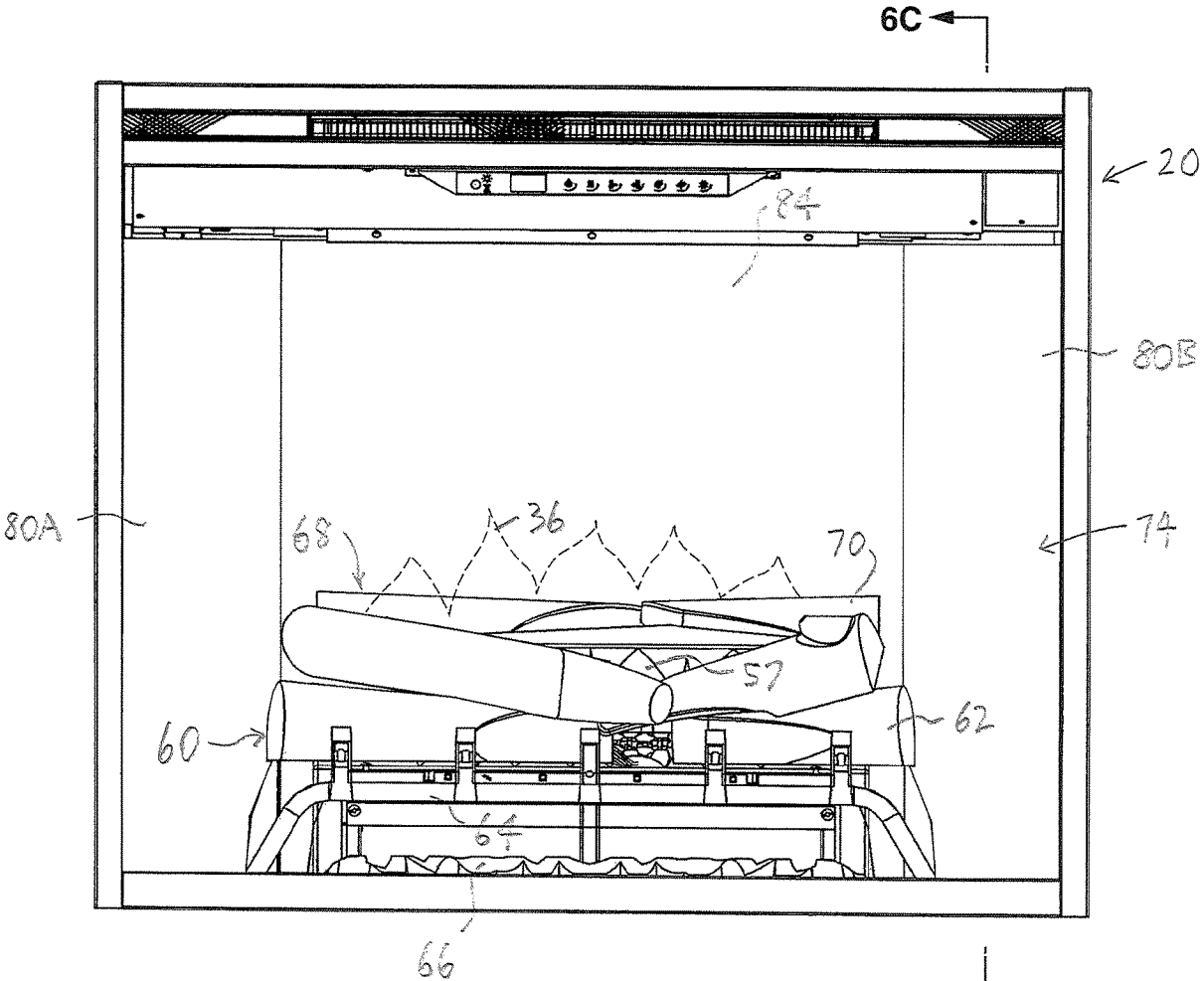
FIG. 6B is a front view of the flame simulating assembly of FIG. 6A.
Figure 6C:
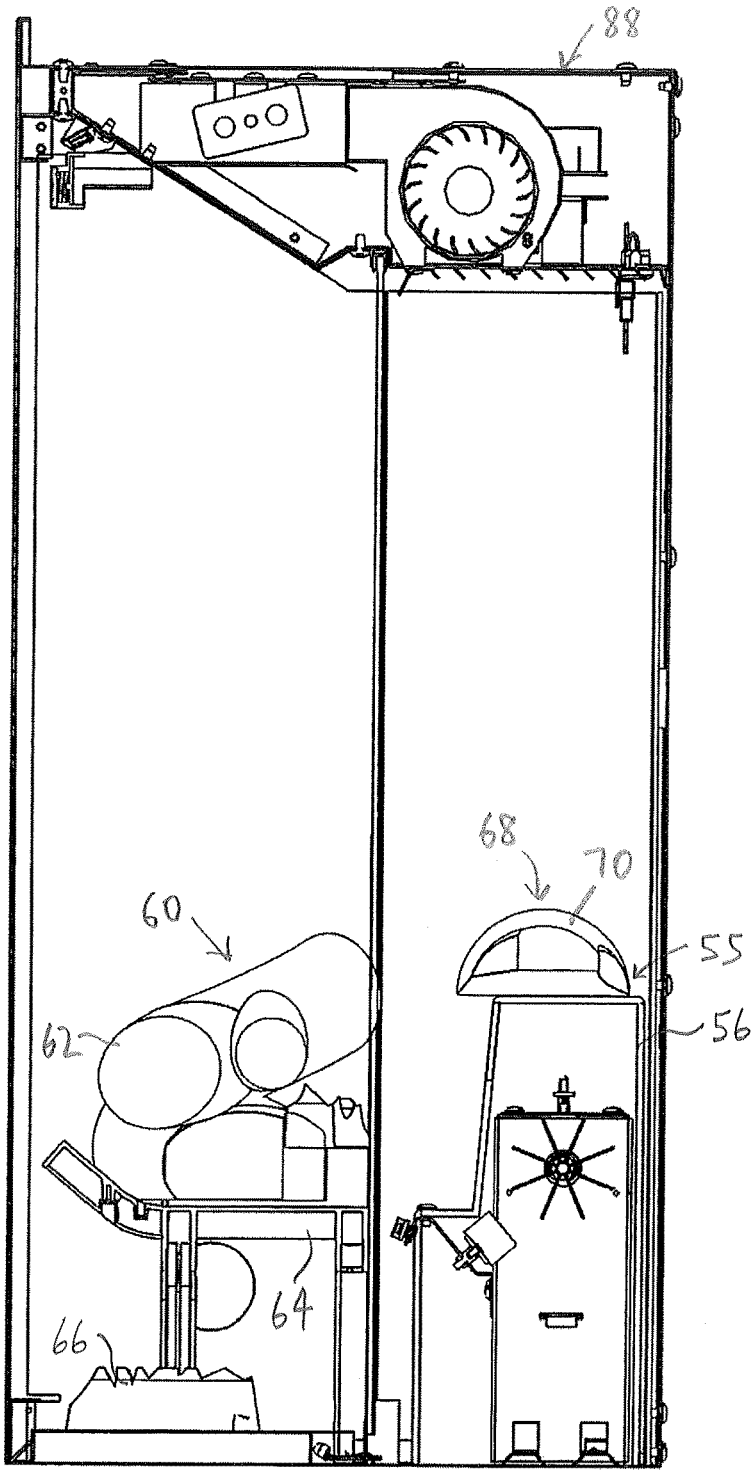
FIG. 6C is a vertical cross-section of the flame simulating assembly of FIGS. 6A and 6B.

In one embodiment, it is preferred that the flame simulating assembly 20 includes internal walls 74 that preferably simulate the walls defining a firebox in a fireplace (FIG. 5). For example, the internal walls 74 may be formed to resemble sheet metal or other material used to form a firebox. Alternatively, the internal walls 74 may be used simply to cover elements of the flame simulating assembly 20 (e.g., structural parts thereof), to enhance the simulating effect of the flame simulating assembly 20.

Figure 7A:
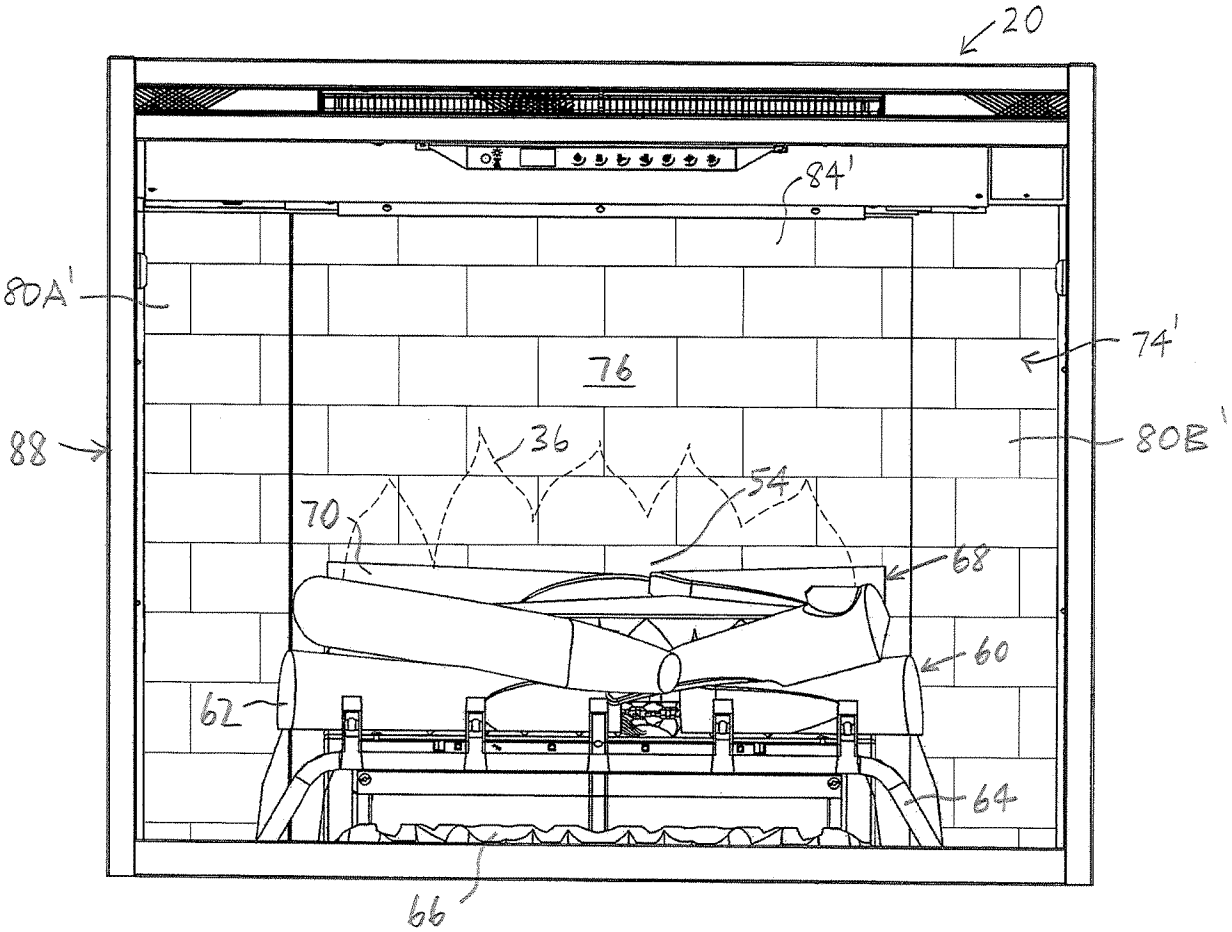
FIG. 7A is a front view of another alternative embodiment of the flame simulating assembly of the invention.

It has been found that the manner in which the internal walls are formed and positioned can significantly enhance the simulating effect thereby provided. The internal walls 74 preferably are, in part, viewable by the observer 58 via the transparent region 32. In one embodiment, internal walls 74 preferably include a simulated firebrick pattern 76 thereon (FIG. 7A). (For clarity of illustration, the internal walls with the firebrick pattern 76 thereon are identified in FIG. 7B by reference numeral 74'). Accordingly, the flame simulating assembly 20 preferably includes simulated firebrick walls 74' that are at least partially positioned behind the screen 22. The simulated firebrick pattern 76 preferably is formed to resemble the firebrick forming a firebox of a fireplace, thereby enhancing the simulating effect of the flame simulating assembly 20.

Figure 7B:
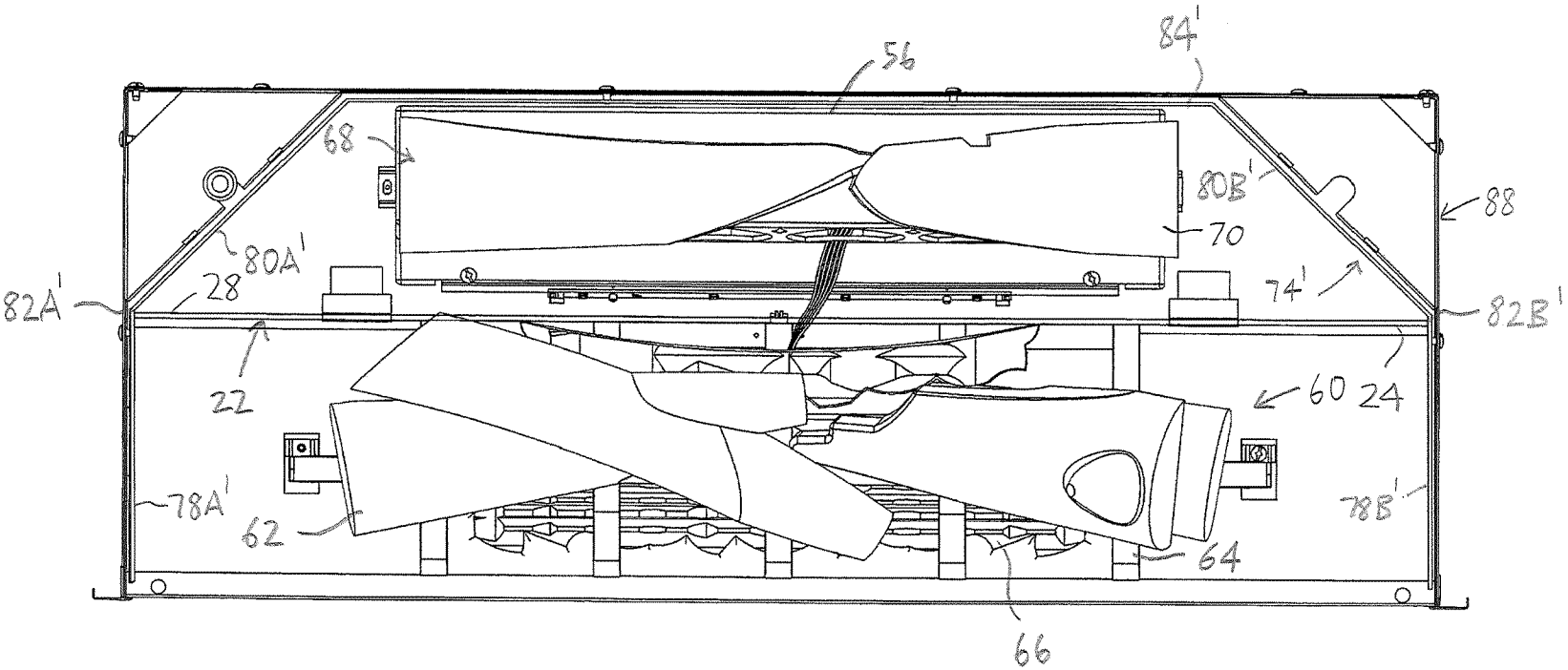
FIG. 7B is a horizontal cross-section of the flame simulating assembly of FIG. 7A.

In one embodiment, the internal walls 74 preferably are positioned at least partially behind the screen 22. Preferably, and as can be seen in FIG. 2E, the internal walls 74 include front walls 78A, 78B positioned in front of the screen 22, and positioned substantially orthogonal to the front surface 24 of the screen 22. It is also preferred that the internal walls 74 include side walls 80A, 80B positioned to define oblique angles with the respective front walls 78A, 78B. The side walls 80A, 80B define respective inflection lines 82A, 82B where they meet the front walls 78A, 78B respectively (FIGS. 7A, 7B). As can be seen in FIG. 2E, it is preferred that the screen 22 is mounted at the inflection lines 82A, 82B. Preferably, the internal walls 74 also include a rear wall 84 that is positioned behind the back surface 28 of the screen 22 and extends between the side walls 80A, 80B.

As can be seen in FIGS. 7A and 7B, the simulated firebrick walls 74' preferably also are positioned at least partially behind the screen 22. Preferably, and as can be seen in FIGS. 7A and 7B, the simulated firebrick walls 74' include front walls 78A', 78B' positioned in front of the screen 22, and positioned substantially orthogonal to the front surface 24 of the screen 22. It is also preferred that the simulated firebrick walls 74' include side walls 80A', 80B' positioned to define oblique angles with the respective front walls 78A', 78B'. The side walls 80A', 80B' define respective inflection lines 82A', 82B' where they meet the front walls 78A', 78B' respectively (FIG. 7B). As can be seen in FIG. 7B, it is preferred that the screen 22 is mounted at the inflection lines 82A', 82B'. Preferably, the simulated firebrick walls 74' also include a rear wall 84' that is positioned behind the back surface 28 of the screen 22 and extends between the side walls 80A, 80B.

It will be understood that the internal walls 74 may be formed and positioned in any suitable arrangement, and that the foregoing description is only an embodiment that is exemplary only. For instance, the internal walls 74 (whether including the firebrick pattern or not) may form a simulated firebox that is rectangular or partially round, or any other suitable shape, in plan view.

Figure 8:
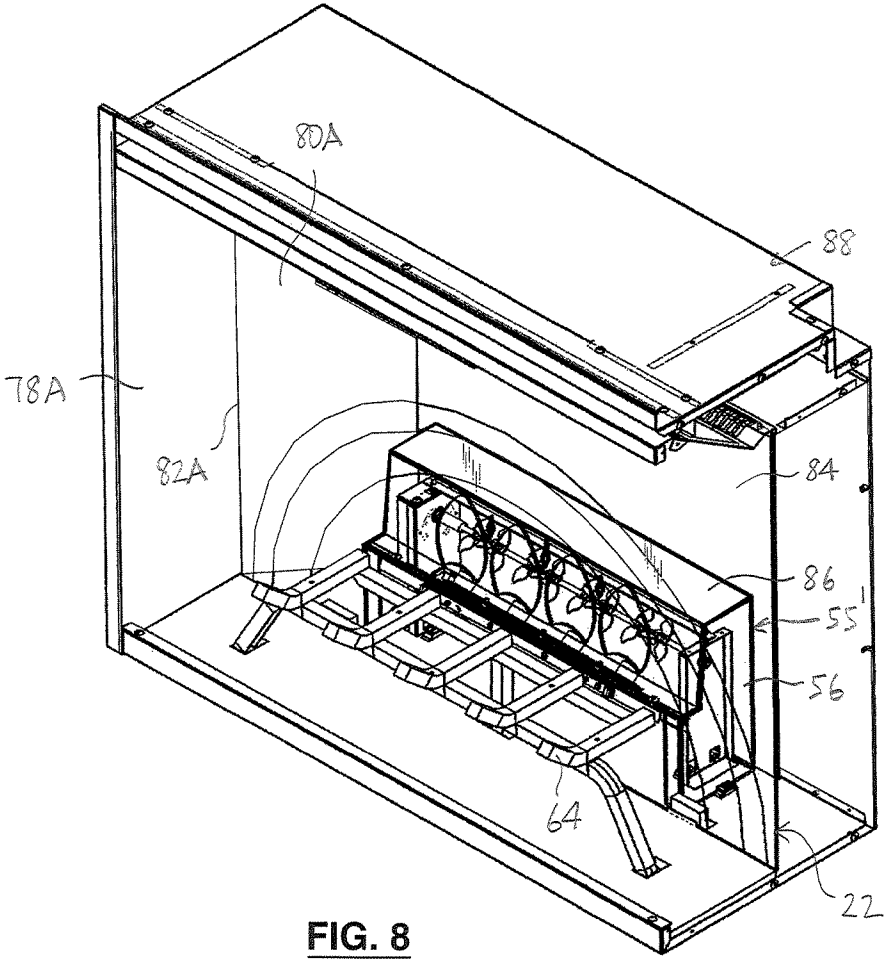
FIG. 8 is an isometric view of another alternative embodiment of the flame assembly of the invention, with certain elements omitted.

As noted above, in one embodiment, the flicker element housing 55 preferably includes the second simulated fuel bed 68, positioned on the flicker element housing body 56. In an alternative embodiment, a flicker element housing 55' preferably includes a mirror or mirror element 86 that is positioned on the flame element housing body 56 (FIG. 8). It will be understood that the flicker element housing is identified by reference numeral 55' in FIG. 8 for clarity of illustration. The mirror 86 preferably is formed to provide specular reflection, and is substantially flat. It has been found that the reflection of the rear wall 84 in the mirror 86 provides the illusion that the flicker element housing 55' is part of the rear wall 84. (It will be understood that the firebrick pattern is not shown on the rear wall 84 in FIG. 8 in order to simplify the illustration.)

In FIG. 4B, the light from the light source(s) 21 that is reflected from the flicker element 34 toward the screen 22 is schematically represented by arrow "A". In one embodiment, the light from the light source(s) 21 that is reflected toward the back surface 28 preferably defines an acute angle (identified as $\ominus$ in FIG. 4B for clarity of illustration) between the light and the back surface 28. Accordingly, the light from the light source(s) 21 is reflected from the flicker element 34 along one or more paths toward the back surface that defines the acute angle $\ominus$ relative to the back surface 28.

Those skilled in the art would appreciate that the angle of incidence ⊖ may be any suitable angle.

In use, the light from the light source is directed onto the flicker element 34 as it rotates. The light is reflected from the flicker element 34 to the back surface 28 of the screen 22. In the translucent region 30, the images of flames 36 are provided. In the fringe region 40, the images of flames are also provided at the diffusing areas 44, but the observer 58 can see past the images of flames 36 via the transparent areas 46. Accordingly, as in a real fire, in the fringe region 40, the images of flames are only partial, i.e., the observer 58 sees gaps laterally between the upper parts of the images of flames, as in a real fire.

In one embodiment, the flame simulating assembly 20 preferably includes a box subassembly 88 in which the other elements of the flame simulating assembly 20 (described above) are mounted (FIG. 5). It will be understood that the flame simulating assembly 20, including the box subassembly 88, may be formed to be positioned in a mantel subassembly (not shown) to be located against a wall. Alternatively, the flame simulating assembly 20 may be receivable in an opening in a wall (not shown) that is sized and shaped for the purpose. As is known, the opening is formed to receive the box subassembly 88. Those skilled in the art would be aware generally of the manner in which the flame simulating assembly 20 (including the box subassembly 88) is positioned in such opening.

Those skilled in the art would appreciate that the diffusing areas and other diffusing parts of the screen may be provided using different techniques, on the front surface or on the back surface. For example, suitable diffusion effects can be achieved by scoring (not shown) on the back surface of the screen.

Those skilled in the art would also appreciate that the partially reflective region 72 may be formed using any suitable method.

Figure 9:
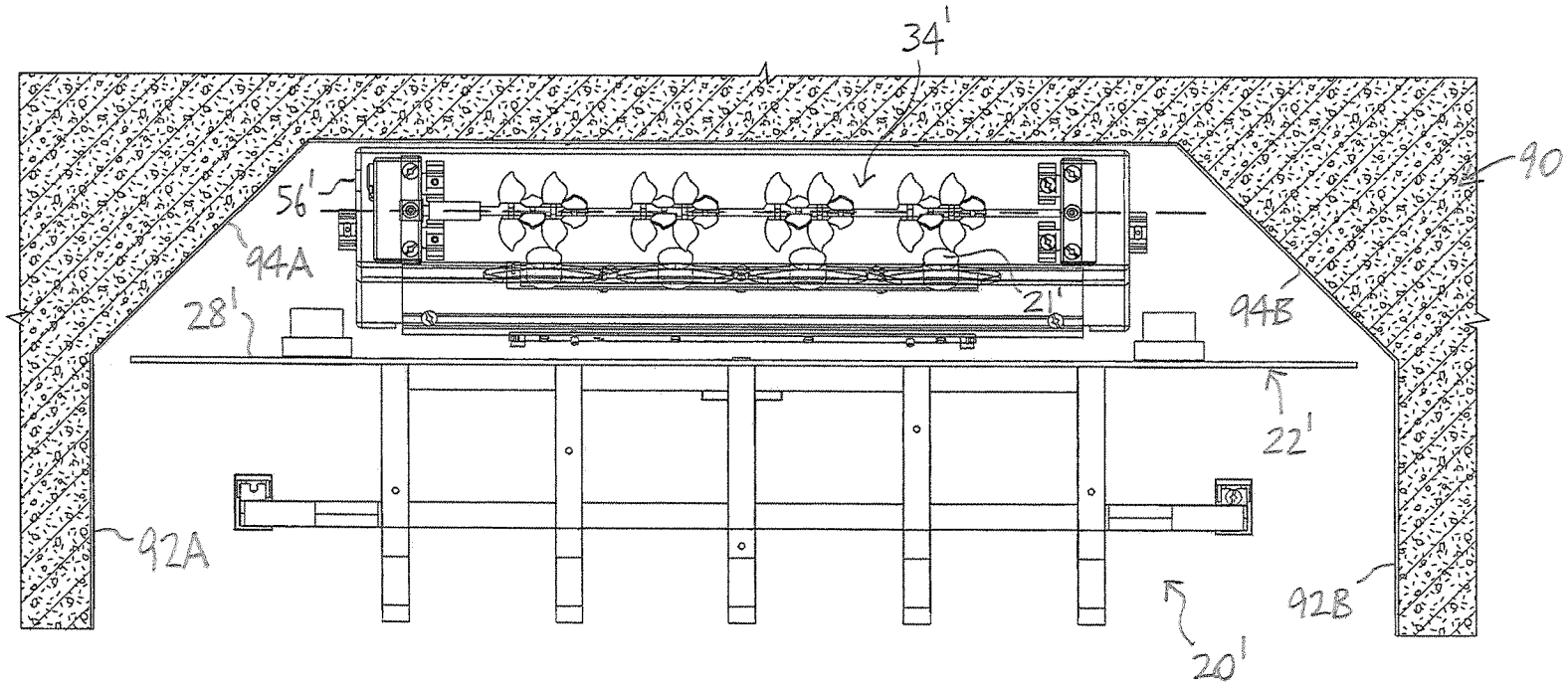
FIG. 9 is a horizontal cross-section of another alternative embodiment of the flame simulating assembly of the invention.

An alternative embodiment of the flame simulating assembly 20' of the invention is illustrated in FIG. 9. The flame simulating assembly 20' is an insert module, formed to be inserted into a pre-existing firebox 90. Because of this, in one embodiment, the flame simulating assembly 20' preferably does not include a box subassembly.

As can be seen in FIG. 9, in one embodiment, the flame simulating assembly 20' preferably includes a screen 22' and one or more light sources 21'. It is also preferred that the flame simulating assembly 20' includes a flicker element 34' rotatably positioned in a flicker element housing body 56'. It will be understood that light from the light source 21' is directed onto the flicker element 34', and the light is reflected therefrom onto a back surface 28' of the screen 22'. Preferably, the screen 22' includes a translucent region, a transparent region, and a fringe region therebetween, as described above (not shown in FIG. 9).

As can also be seen in FIG. 9, it is preferred that the screen 22' fits between front walls 92A, 92B and side walls 94A, 94B of the pre-existing firebox 90. It will be understood that the screen 22' does not necessarily extend to engage the side walls of the pre-existing firebox 90. Those skilled in the art would appreciate that the flame simulating assembly 20' provides a realistic simulation of flames positioned in the pre-existing firebox 90.

Figure 10B:
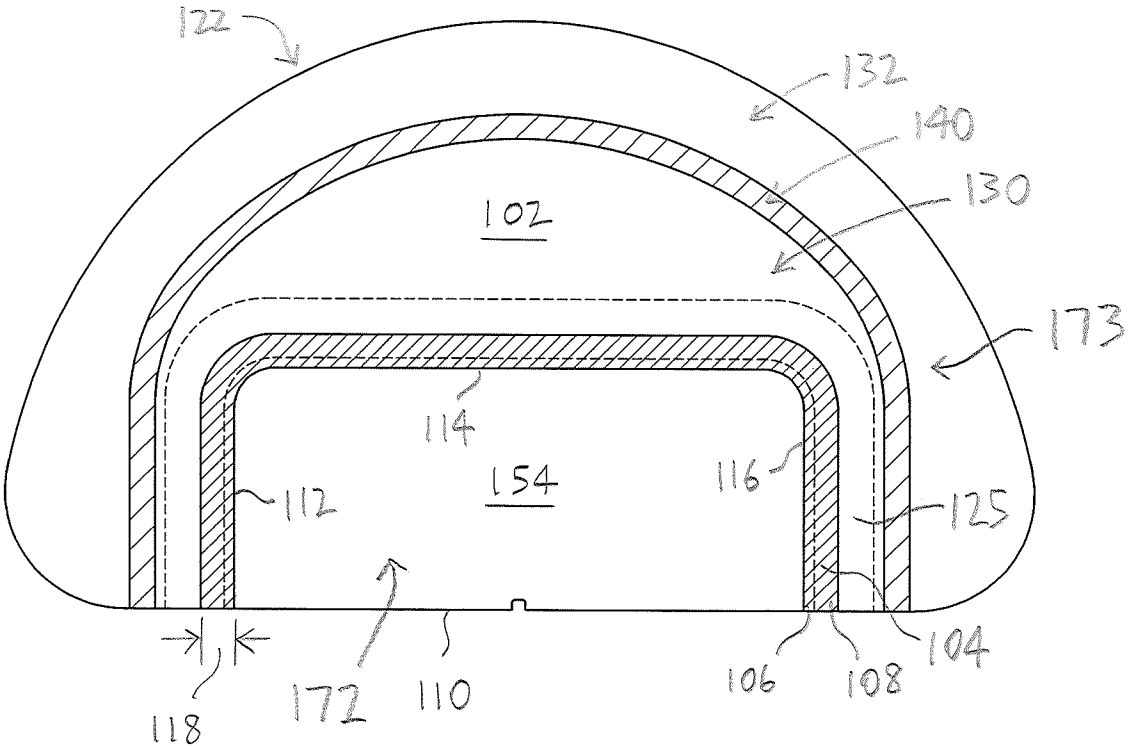
FIG. 10B is a front view of another alternative embodiment of a screen of the invention.
Figure 11B:
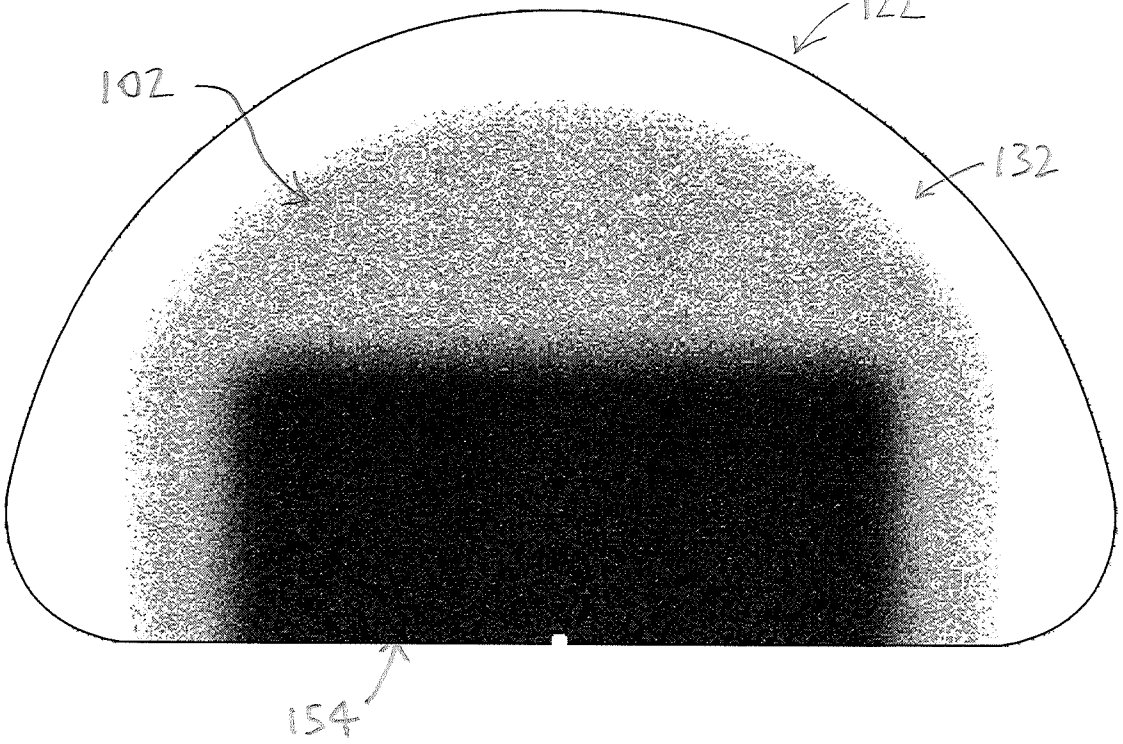
FIG. 11B is another front view of the screen of FIG. 10B.
Figure 12B:
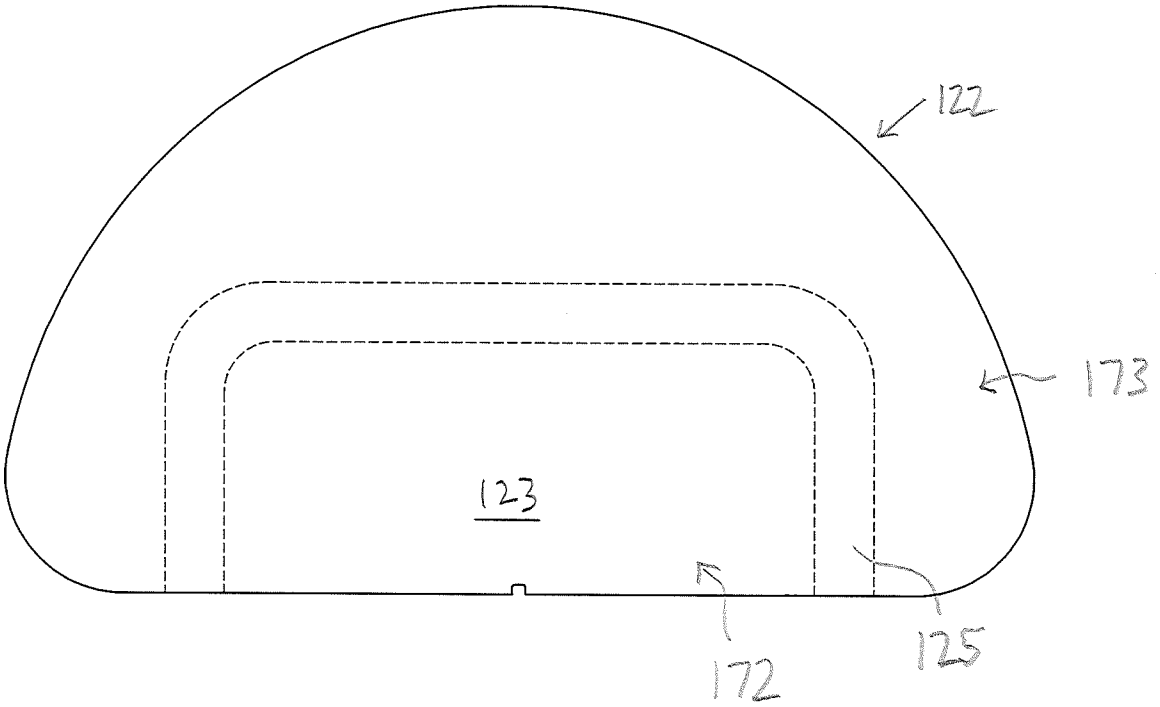
FIG. 12B is another front view of the screen of FIGS. 10B and 11B.
Figure 13A:
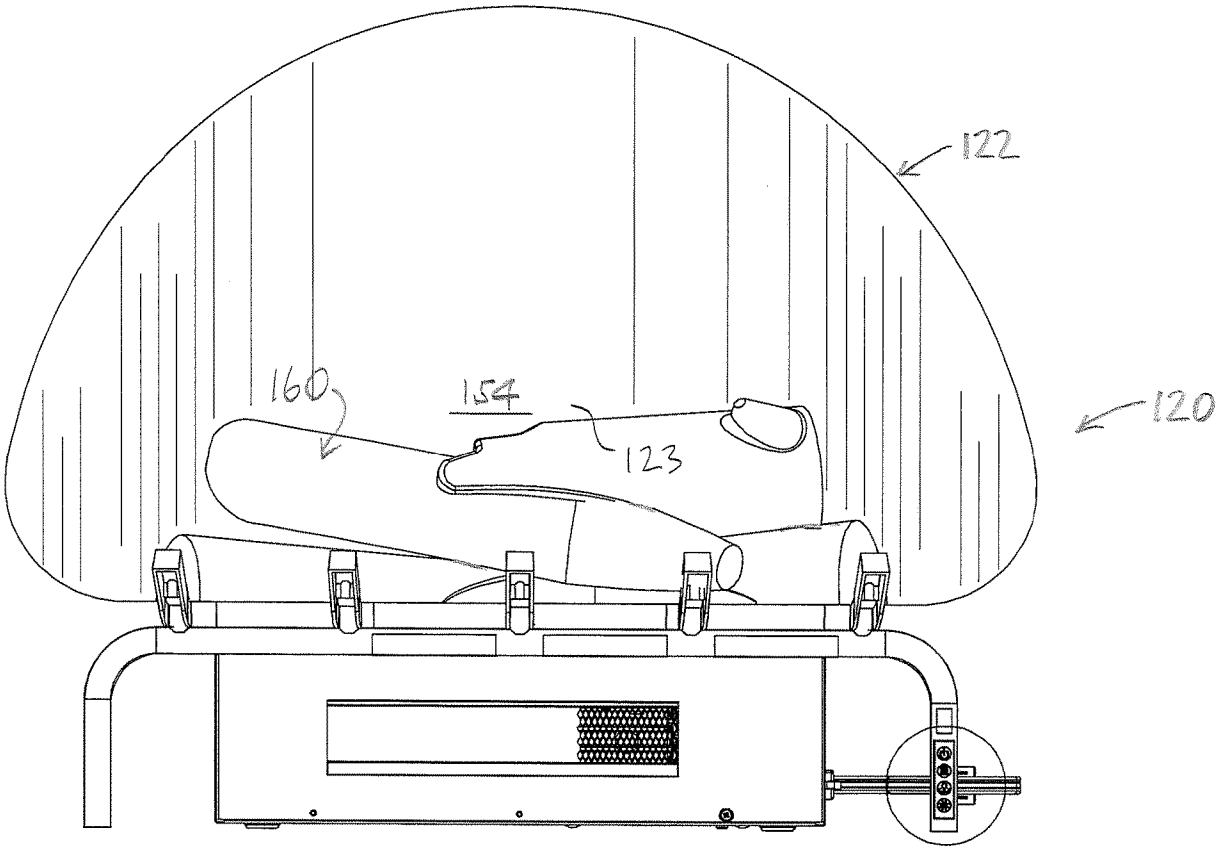
FIG. 13A is a front view of an alternative embodiment of the flame simulating assembly of the invention, drawn at a smaller scale.
Figure 13B:
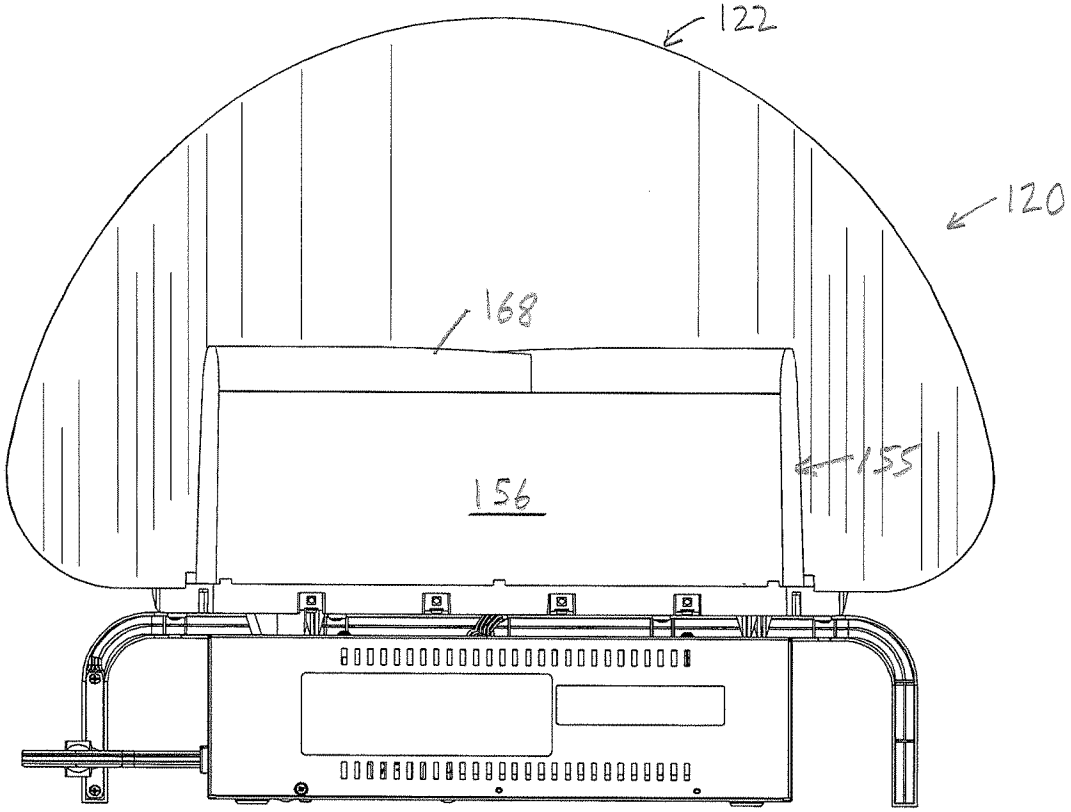
FIG. 13B is a back view of the flame simulating assembly of FIG. 13A.
Figure 13C:
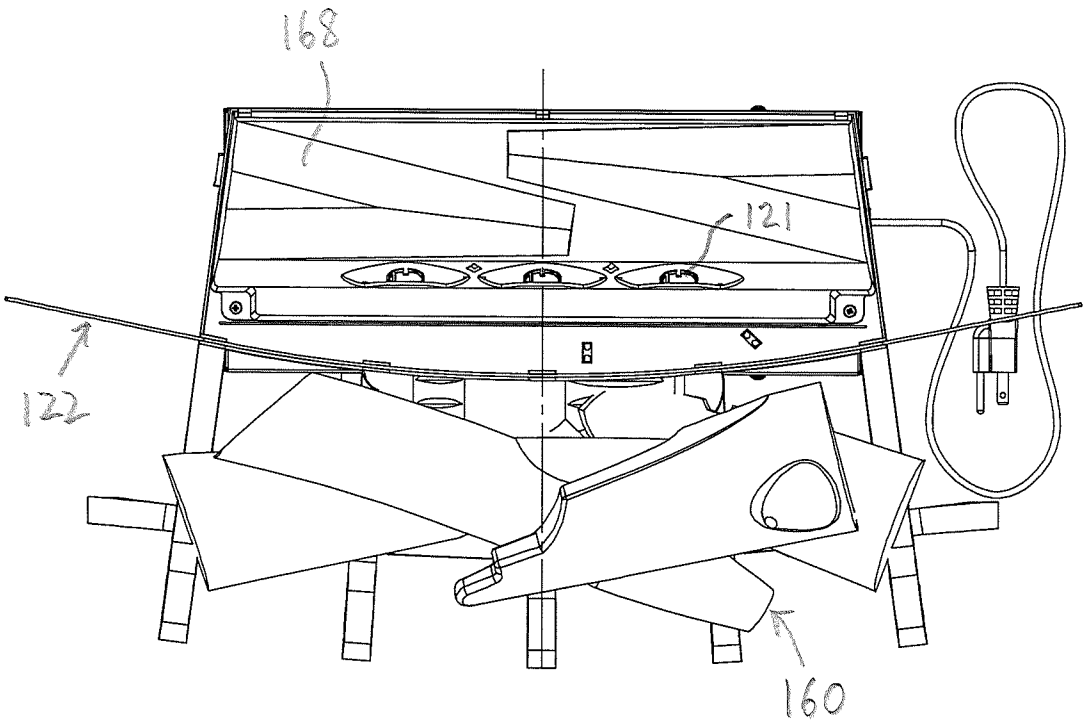
FIG. 13C is a top view of the flame simulating assembly of FIGS. 13A and 13B.
Figure 13D:
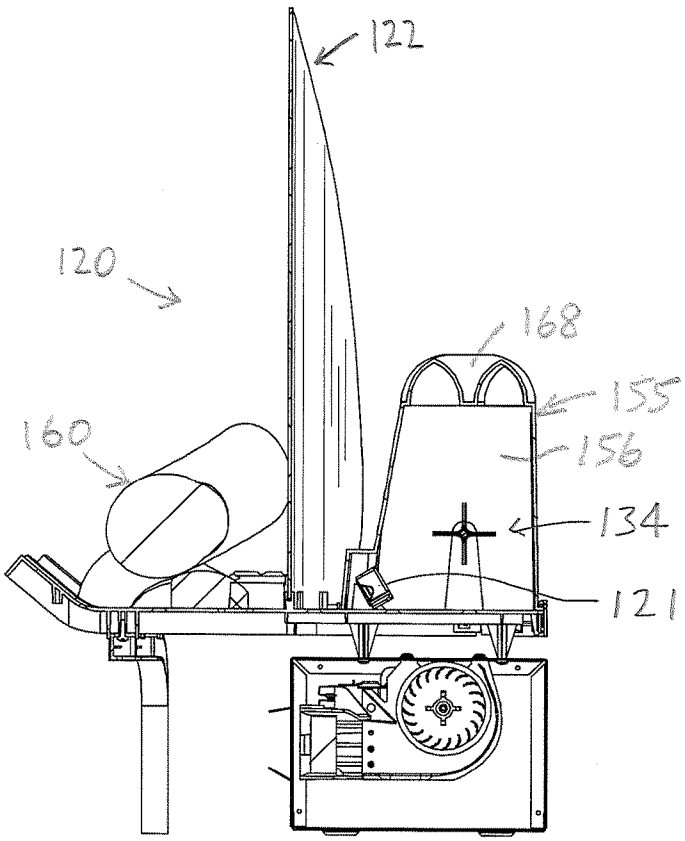
FIG. 13D is a side view of the flame simulating assembly of FIGS. 13A-13C.

An alternative embodiment of the flame simulating assembly 120 of the invention is illustrated in FIGS. 13A-13D. Preferably, the flame simulating assembly 120 includes an alternative embodiment of a screen 122 of the invention that is also illustrated in FIGS. 10B, 11B, and 12B. The flame simulating assembly 120 is an insert module (i.e., intended to be positioned in an existing conventional firebox). The flame simulating assembly 120 includes one or more light sources 121 and a flicker element 134 for reflecting light from the light source(s) 121 toward the screen 122 (FIG. 13D).

Figure 10A:
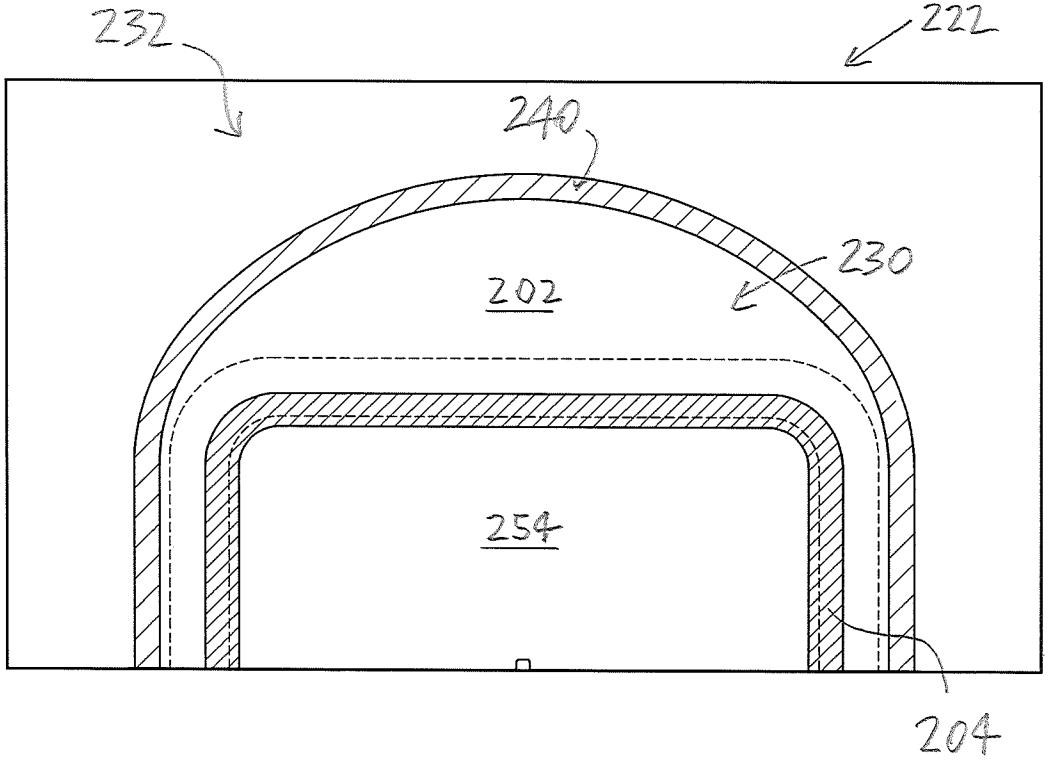
FIG. 10A is a front view of an alternative embodiment of a screen of the invention, drawn at a smaller scale.
Figure 11A:
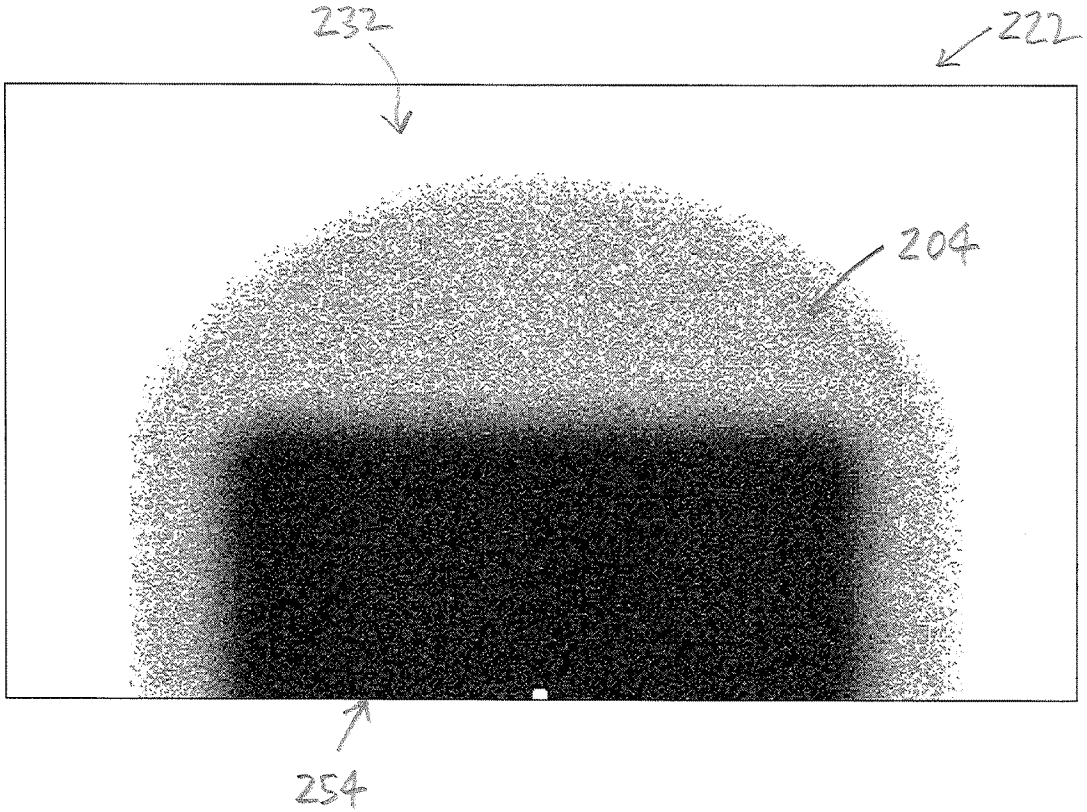
FIG. 11A is another front view of the screen of FIG. 10A.
Figure 12A:
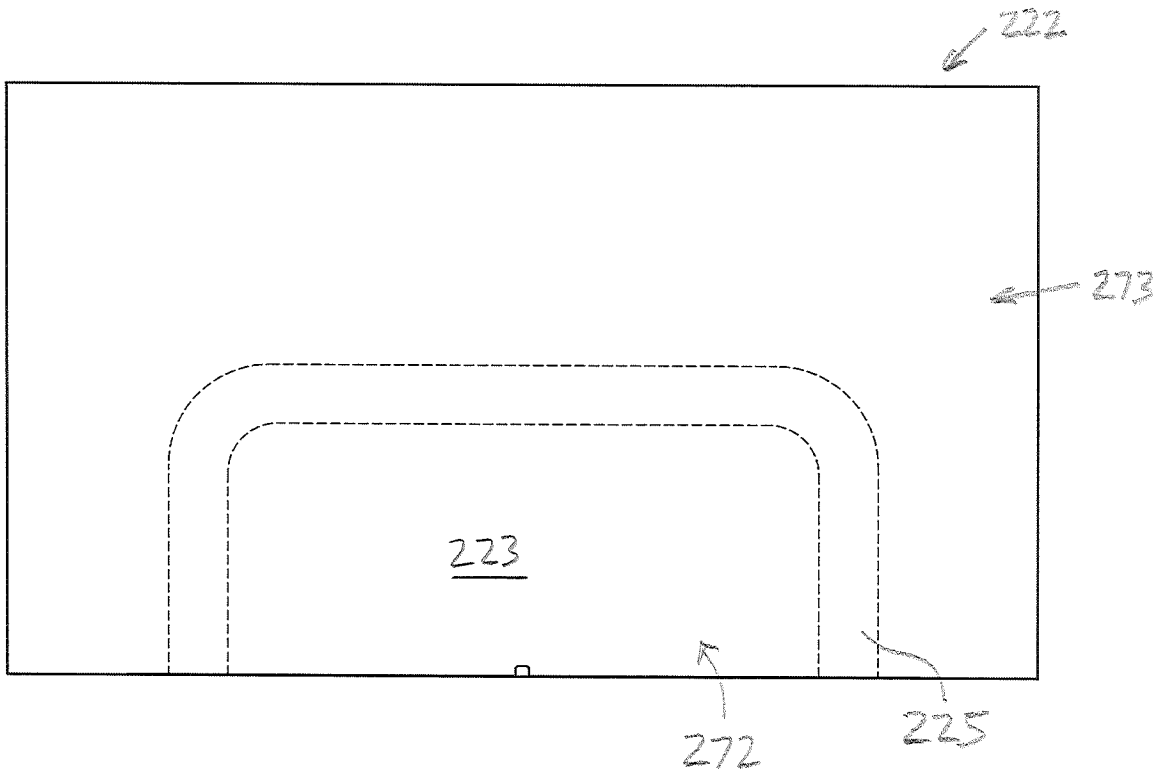
FIG. 12A is another front view of the screen of FIGS. 10A and 11A.

An alternative embodiment of the screen 222 of the invention is illustrated in FIGS. 10A, 11A, and 12A. It will be understood that the screen 222 is the same as the screen 122, except that the screen 222 is generally rectangular, and the screen 122 is not. It will be understood that the screen 222 is to be included in the embodiment of the flame simulating assembly that includes the box subassembly 88, described above.

As can be seen in FIGS. 13A-13D, in one embodiment, the screen 122 preferably is curved. The screen 122 may be convex relative to a trim subassembly or front simulated fuel bed 160, i.e., from the point of view of an observer 158 positioned in front of the flame simulating assembly 120. The screen 122 may be curved as shown in FIGS. 13A-13D in order to enhance the overall simulation effect provided by the flame simulating assembly 120, for example, when the flame simulating assembly 120 is located in a prior art firebox (not shown in FIGS. 13A-13D).

Alternatively, the screen 122 may be substantially planar. It will be understood that, for clarity of illustration, the screens 122 and 222 illustrated in FIGS. 10A-12B are substantially planar.

Preferably, the screen 122 includes a translucent region 130, a transparent region 132, and a fringe region 140 located therebetween. In one embodiment, the translucent region 130 preferably includes one or more peripheral sub-regions 102 that are at least partially contiguous with a central sub-region 154, as will be described. It is preferred that the light from the light source 121 that is directed through the peripheral sub-region 102 is subjected to less diffusion than the light from the light source 121 that is directed through the central sub-region 154.

Various parts of the screen 122 are illustrated in FIG. 10B. In one embodiment, the treatment of the screen that causes the light transmitted therethrough to be diffused preferably is adjusted or graded, so that the light that is transmitted through the central sub-region 154 is subjected to more diffusion than is the light that is transmitted through the peripheral sub-region(s) 102. For example, where the translucent region 130 is formed using silk screening, the central sub-region 154 may have approximately 75 percent to approximately 100 percent coverage, and the peripheral sub-region(s) 102 may have about 12 percent coverage. As is known in the art, the percentages noted above, namely 75 percent and 12 percent, refer to the portion of the area of the region in question that is covered with ink in the silk screening process.

Those skilled in the art would appreciate that, depending on the circumstances (including, e.g., the viscosity of the ink, and the thickness of the ink when in the artwork), the nominal coverage percentage may result in a somewhat different coverage percentage in practice. For example, it may be desired to have approximately 100 percent coverage, in practice, in the central sub-region 154. However, in order to achieve this, it may be desirable to limit the nominal coverage percentage, i.e., the coverage percentage when the ink is in the artwork, to approximately 75 percent. This is because, due to the tendency of the ink to "bleed", approximately 75 percent nominal coverage in the artwork may result in approximately 100 percent coverage in the central region 154 in practice.

Those skilled in the art would also be aware of a variety of methods of forming the central sub-region and the peripheral region(s) so that they are treated differently, to subject the light from the light source 121 reflected by the flicker element 134 (FIG. 13D) therethrough to diffusion to different extents therein. Also, the extent to which the diffusing properties of the central sub-region 154 and the peripheral sub-region(s) 102 differ from one sub-region to the next is variable. Such sub-regions may be formed to have any suitable, different, diffusion properties.

In another alternative embodiment, the translucent region 130 preferably also includes a diffusion transition sub-region 104 located at least partially between the central sub-region 154 and the peripheral sub-region 102 (FIG. 10B). Preferably, the diffusion transition sub-region 104 is configured to subject the light from the light source 121 transmitted through inner portions 106 of the diffusion transition sub-region 104 proximal to the central sub-region 154 to more diffusion than the light from the light source 121 that is transmitted through outer portions 108 of the transition diffusion sub-region 104 that are distal to the central sub-region 154, to provide a substantially uniform transition between the central sub-region 154 and the peripheral sub-region 102. The diffusion transition sub-region 104 preferably provides a gradual, substantially uniform, transition between the central sub-region 154 and the peripheral sub-region(s) 102.

Those skilled in the art would also appreciate that the central sub-region 154 and the peripheral sub-region 102 may have any suitable shapes. For example, in FIG. 10B, the central sub-region 154 is shown as being generally rectangular in shape, with one side thereof (identified for convenience by reference numeral 110 in FIG. 10B) being adjacent to a bottom edge of the screen. The three other sides of the central sub-region are identified for convenience in FIG. 10B by reference numerals 112, 114, and 116. As can be seen in FIG. 10B, in one embodiment, it is preferred that there is only one peripheral sub-region 102, and that such peripheral sub-region 102 is positioned around the central sub-region 154, except for the side 110 of the central sub-region 154. As can also be seen in FIG. 10B, the peripheral sub-region 102 preferably is spaced apart from the three sides 112, 114, 116 of the central sub-region 154 by a distance identified for convenience by reference numeral 118. It is also preferred that the diffusion transition sub-region 104 is located between the central sub-region 154 and the peripheral sub-region 102.

As described above, the transition diffusion sub-region 104 preferably provides a substantially uniform gradual change in the extent to which light from the light source transmitted therethrough is subjected to diffusion, from the outer portion 108 to the inner portion 106, and vice versa. As illustrated, there is only one transition diffusion sub-region 104. However, it will be understood that, if preferred, the screen may include several peripheral sub-regions, and the screen also may include several transition diffusion sub-regions.

Preferably, and as can be seen in FIG. 10B, the peripheral sub-region 102 is at least partially contiguous with the fringe region 140 that is also included in the screen 122. The fringe region 140 preferably is positioned between the translucent region 130 and the transparent region 132. As described above, the fringe region 140 provides a gradual, preferably substantially uniform transition between the peripheral sub-region 102 and the transparent region 132.

As can be seen in FIG. 10A, the screen 222 preferably also includes a translucent region 230, a transparent region 232, and a fringe region 240 located therebetween. It is also preferred that the translucent region 230 includes a central sub-region 254, a peripheral sub-region 202, and a transition diffusion sub-region 204 located therebetween.

In one embodiment, the screen 122 may include one or more at least partially reflective regions 172. As illustrated in FIGS. 10B and 12B, the screen 122 preferably includes one or more partially reflective region(s) 172 at least partially overlapping with the translucent region 130, and one or more non-reflective regions 173 at least partially contiguous with the partially reflective region 172. It will be understood that the partially reflective region is for partially reflecting portions of a trim subassembly 160, as described above.

Preferably, the partially reflective region 172 includes a core sub-region 123 that at least partially overlaps with the central sub-region 154.

It is preferred that the partially reflective region 172 additionally includes a reflection transition region 125 located at least partially contiguous with the core sub-region 123 to provide a substantially uniform, or gradual transition between the core sub-region 123 and the non-reflective region 173.

The partially reflective region 172 and the reflection transition region 125 are also shown in FIG. 10B. It will be understood that the partially reflective region 172, the non-reflective region 173, and the reflective transition region 125 may all be located relative to the translucent region 130 and the transparent region 132 in any relationship that provides a suitable overall flame simulation effect. In one embodiment, it is preferred that the diffusion transition region 104 and the reflection transition region 125 at least partially overlap (FIG. 10B). Preferably, the peripheral sub-region 102 is at least partially contiguous with the fringe region 140. As can be seen in FIGS. 10B and 12B, in one embodiment, the fringe region 140 and the transparent region 132 preferably are not overlapped by the partially reflective region 172. It will be understood, however, that the fringe region 140 and/or the transparent region 132 may be so overlapped. (The translucent region 130, the transparent region 132, and the fringe region 140 are omitted from FIG. 12B for clarity of illustration.)

As can be seen in FIGS. 10A and 12A, in one embodiment, the screen 222 preferably includes a partially reflective region 272 that at least partially overlaps the translucent region 230. The screen 222 preferably also includes a non-reflective region 273. The partially reflective region 272 preferably also includes a core sub-region 223 and a reflective transition region 225 positioned between the core sub-region 223 and the non-reflective region 273. The reflective transition region 225 preferably provides a gradual, uniform transition between the core sub-region 223 and the non-reflective region 273. The partially reflective region 272 and the non-reflective region 273 are illustrated in FIG. 12A with the translucent region 230, the transparent region 232, and the fringe region 240 omitted for clarity of illustration.

FIGS. 11A and 11B are provided to illustrate the appearance of the screens 222, 122 respectively, based on the arrangements illustrated in FIGS. 10A and 10B.

As can be seen in FIGS. 13A and 13D, it is also preferred that the flame simulating assembly 120 additionally includes a flicker element housing 155 for at least partially concealing the flicker element 134. As described above, the flicker element housing 155 preferably includes a flicker element housing body 156 for at least partially concealing the flicker element 134.

Preferably, the trim subassembly 160 or first simulated fuel bed is positioned proximal to the central sub-region 154, for reflection of at least part of the first simulated fuel bed 160 in the core sub-region 123 (FIG. 13A).

It is also preferred that the flicker element housing 155 additionally includes a second simulated fuel bed 168 (FIGS. 13B-13D). The second simulated fuel bed 168 preferably is positioned on the flicker element housing body 156, to at least partially cover the flicker element housing body 156.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

We claim:

1. A flame simulating assembly comprising:

at least one light source for providing light;

a screen having a front surface facing toward a front side of the flame simulating assembly and a back surface opposed to the front surface, the screen comprising:

at least one translucent region which subjects the light from said at least one light source transmitted therethrough to diffusion; and at least one transparent region;

a flicker element for intermittently reflecting the light from said at least one light source toward the back surface of the screen, to provide images of flames in a predetermined portion thereof; and the screen comprising at least one fringe region at least partially positioned between said at least one translucent region and said at least one transparent region, said at least one fringe region comprising a plurality of diffusing areas for diffusing the light from the light source and a plurality of transparent areas positioned between the diffusing areas, to at least partially provide images of flames in the diffusing areas.

2. The flame simulating assembly according to claim 1 in which said at least one translucent region comprises a central sub-region located in a predetermined location on the screen.

3. The flame simulating assembly according to claim 2 in which the predetermined location of the central sub-region is selected such that the images of flames appear to originate from the central sub-region.

4. The flame simulating assembly according to claim 1 in which the diffusing areas are substantially round.

5. The flame simulating assembly of claim 1 in which at least portions of the diffusing areas are oblong.

6. The flame simulating assembly according to claim 1 additionally comprising a flicker element housing for at least partially concealing the flicker element.

7. The flame simulating assembly according to claim 6 additionally comprising a simulated fuel bed positioned proximal to the central sub-region.

8. The flame simulating assembly according to claim 7 in which the flicker element housing additionally comprises a second simulated fuel bed.

9. The flame simulating assembly according to claim 1 additionally comprising at least one partially reflective region that at least partially overlaps with said at least one translucent region.

10. The flame simulating assembly according to claim 1 additionally comprising simulated firebrick walls positioned at least partially behind the screen.

11. The flame simulating assembly according to claim 1 additionally comprising:

a plurality of internal walls positioned at least partially behind the screen, said internal walls comprising:

front walls positioned in front of the screen, positioned substantially orthogonal to the front surface of the screen;

side walls positioned to define oblique angles with the respective front walls, the side walls defining respective inflection lines where they meet the front walls respectively;

the screen being mounted at the inflection lines; and a rear wall positioned behind the back surface of the screen and extending between the side walls.

12. The flame simulating assembly according to claim 11 additionally comprising:

a flicker element housing in which the flicker element is positioned, to at least partially cover the flicker element; and at least one mirror element positioned on the flicker element housing, for reflecting at least a selected part of the rear wall.

13. The flame simulating assembly according to claim 1 in which the light from said at least one light source is reflected from the flicker element along at least one path toward the back surface that defines an acute angle relative to the back surface.

14. The flame simulating assembly according to claim 3 in which:

said at least one translucent region comprises at least one peripheral sub-region that is at least partially contiguous with the central sub-region; and the light from said at least one light source that is directed through said at least one peripheral sub-region is subjected to less diffusion than the light from said at least one light source that is directed through the central sub-region.

15. The flame simulating assembly according to claim 14 in which said at least one translucent region additionally comprises a diffusion transition sub-region located at least partially between the central sub-region and said at least one peripheral sub-region, the diffusion transition sub-region being configured to subject the light from said at least one light source transmitted through inner portions of the diffusion transition sub-region proximal to the central sub-region to more diffusion than the light from said at least one light source that is transmitted through outer portions of the transition diffusion sub-region that are distal to the central sub-region, to provide a substantially uniform gradual transition between the central sub-region and said at least one peripheral sub-region.

16. The flame simulating assembly according to claim 15 in which said at least one peripheral sub-region is at least partially contiguous with said at least one fringe region.

17. The flame simulating assembly according to claim 15 in which the screen additionally comprises at least one partially reflective region at least partially overlapping with said at least one translucent region, and at least one non-reflective region at least partially contiguous with said at least one partially reflective region.

18. The flame simulating assembly according to claim 17 in which said at least one partially reflective region comprises a core sub-region that at least partially overlaps with the central sub-region.

19. The flame simulating assembly according to claim 17 in which said at least one partially reflective region additionally comprises a reflection transition region located at least partially contiguous with the core sub-region to provide a substantially uniform gradual transition between the core sub-region and said at least one non-reflective region.

20. The flame simulating assembly according to claim 19 in which the diffusion transition sub-region and the reflection transition region at least partially overlap.

21. The flame simulating assembly according to claim 20 in which said at least one peripheral sub-region is at least partially contiguous with said at least one fringe region.

22. The flame simulating assembly according to claim 21 additionally comprising a flicker element housing for at least partially concealing the flicker element.

23. The flame simulating assembly according to claim 22 additionally comprising a first simulated fuel bed positioned proximal to the central sub-region, for reflection of at least part of the first simulated fuel bed in the core sub-region.

24. The flame simulating assembly according to claim 23 in which the flicker element housing additionally comprises a second simulated fuel bed.

* * * * *